US012214393B2

(12) United States Patent
Nie et al.

(10) Patent No.: US 12,214,393 B2
(45) Date of Patent: Feb. 4, 2025

(54) MAGNESIUM OR MAGNESIUM ALLOY HAVING ULTRA-HIGH FORMABILITY AT ROOM TEMPERATURE AND MANUFACTURING METHOD THEREOF

(71) Applicants: BAOSHAN IRON & STEEL CO., LTD., Shanghai (CN); China Baowu Steel Group Corporation Limited, Shanghai (CN)

(72) Inventors: Jianfeng Nie, Clayton (AU); Zhuoran Zeng, Clayton (AU); Shiwei Xu, Shanghai (CN); Nick Birbilis, Clayton (AU); Christopher H. J. Davies, Clayton (AU); Weineng Tang, Shanghai (CN)

(73) Assignees: BAOSHAN IRON & STEEL CO., LTD., Shanghai (CN); CHINA BAOWU STEEL GROUP CORP., LTD., Shanghai (CN)

( * ) Notice: Subject to any disclaimer, the term of this patent is extended or adjusted under 35 U.S.C. 154(b) by 497 days.

(21) Appl. No.: 16/649,867

(22) PCT Filed: Sep. 21, 2018

(86) PCT No.: PCT/CN2018/106867
§ 371 (c)(1),
(2) Date: Mar. 23, 2020

(87) PCT Pub. No.: WO2019/057139
PCT Pub. Date: Mar. 28, 2019

(65) Prior Publication Data

US 2020/0269297 A1 Aug. 27, 2020

(30) Foreign Application Priority Data

Sep. 25, 2017 (CN) ..... 201710875802.0

(51) Int. Cl.
*B21C 23/00* (2006.01)
*C22C 23/00* (2006.01)

(52) U.S. Cl.
CPC ..... *B21C 23/002* (2013.01); *C22C 23/00* (2013.01)

(58) Field of Classification Search
CPC ..... B21C 23/002; C22C 23/00; C22F 1/06
See application file for complete search history.

(56) References Cited

U.S. PATENT DOCUMENTS 7,871,476 B2 * 1/2011 Mukai ..... C22C 23/04 148/420
2014/0332121 A1 * 11/2014 Park ..... C22C 23/02 148/420

(Continued)

FOREIGN PATENT DOCUMENTS

CN 1981064 6/2007
CN 1981064 A 6/2007

(Continued)

OTHER PUBLICATIONS

Kr 20160136829A, Park et al. machine translation (Year: 2016).*

(Continued)

*Primary Examiner* — John A Hevey
(74) *Attorney, Agent, or Firm* — Lei Fang, Esq.; Smith Tempel Blaha LLC

(57) ABSTRACT

The present invention provides magnesium or magnesium alloys having high formability at room temperature, the magnesium or magnesium alloys having a grain size ≤2 microns. The present invention also provides a method for manufacturing the magnesium or magnesium alloys having (Continued)

high formability at room temperature. The magnesium or magnesium alloys having high formability at room temperature are prepared by simple processing means. The present invention overcomes a problem of poor formability at room temperature.

6 Claims, 19 Drawing Sheets

(56) References Cited

U.S. PATENT DOCUMENTS

| | | | | |
|---|---|---|---|---|
| 2016/0024629 | A1* | 1/2016 | Liang | C22F 1/06 148/420 |
| 2017/0355020 | A1* | 12/2017 | Hassan | C22C 32/0005 |
| 2019/0078186 | A1 | 3/2019 | Somekawa et al. | |

FOREIGN PATENT DOCUMENTS

| | | | | | |
|---|---|---|---|---|---|
| CN | 101768689 | | | 7/2010 | |
| CN | 101768689 | B | | 3/2012 | |
| CN | 102388157 | | | 3/2012 | |
| CN | 102388157 | A | | 3/2012 | |
| CN | 102703785 | | | 10/2012 | |
| CN | 102703785 | A | | 10/2012 | |
| CN | 104018050 | A | | 9/2014 | |
| CN | 105142687 | | | 12/2015 | |
| CN | 105142687 | A | | 12/2015 | |
| CN | 105483484 | | | 4/2016 | |
| CN | 105483484 | A | | 4/2016 | |
| CN | 105603341 | A | | 5/2016 | |
| CN | 106048269 | A | | 10/2016 | |
| CN | 106282623 | | | 1/2017 | |
| CN | 106282623 | A | | 1/2017 | |
| EP | 2690070 | A1 | | 1/2014 | |
| EP | 3132755 | A1 | | 2/2017 | |
| JP | 2000073152 | | | 3/2000 | |
| JP | 2000073152 | A | | 3/2000 | |
| JP | 2003096549 | A | | 4/2003 | |
| JP | 2006016658 | A | | 1/2006 | |
| JP | 2014152354 | A | * | 8/2014 | |
| JP | 2014152361 | | | 8/2014 | |
| JP | 2014152361 | A | | 8/2014 | |
| JP | 2016017183 | A | | 2/2016 | |
| JP | 2016089228 | A | | 5/2016 | |
| JP | 2020534443 | A | | 2/2021 | |
| KR | 20160136829 | A | * | 11/2016 | |
| RU | 2384639 | C2 | | 3/2010 | |
| WO | 2008117890 | A1 | | 10/2008 | |
| WO | WO-2010110505 | A1 | * | 9/2010 | C22C 23/04 |
| WO | 2017154969 | A1 | | 9/2017 | |
| WO | WO2019057139 | A1 | | 3/2019 | |

OTHER PUBLICATIONS

WO-2010110505-A1, Bae, machine translation. (Year: 2010).*

JP-2014152354-A, Somekawa, machine translation. (Year: 2014).*

A. Yu. Volkov, et al., "Improving the mechanical properties of pure magnesium through cold hydrostatic extrusion and low-temperature annealing," Materials Science & Engineering A, 627 (2015), pp. 56-60. (Year: 2015).*

International Search Report and Written Opinion mailed on Dec. 10, 2018 for PCT Patent Application No. PCT/CN2018/106867.

Ku, He, J. A. Liu, and S. S. Xie. "Magnesium alloys fabrication and processing technology." China Metallurgical Industry Press, Beijing (2007). pp. 11 and 211-212.

AU Office Action dated Nov. 13, 2020 for the corresponding AU App. No. 2018337150.

BR Office Action dated Jul. 26, 2022 for the corresponding BR App. No. 1120200052574.

The First Office Action dated May 18, 2021; the Second Office Action dated Feb. 25, 2022; and the Third Office Action dated Dec. 2, 2022 for the corresponding CA App. No. 3076849.

The First Office Action dated Mar. 4, 2022 for the corresponding EP App. No. 18858299.3.

The First Office Action dated Feb. 7, 2021 for the corresponding IN App. No. 202017012967.

The First Office Action dated Apr. 21, 2021; the Second Office Action dated Mar. 22, 2022; and the Third Office Action dated Dec. 2, 2022 for the corresponding JP App. No. 2020-537831.

The First Office Action dated Apr. 4, 2020 and the Second Office Action dated Feb. 16, 2023 for the corresponding RU App. No. 2020113400.

The First Office Action dated May 13, 2020 and the Second Office Action dated Sep. 25, 2020 for the corresponding CN App. No. 201710875802.0.

Hidetoshi Somekawa and Toshiji Mukai, "Hall-Petch Breakdown in Fine-Grained Pure Magnesium at Low Strain Rates" Metallurgical and Materials Transactions A, Springer US, New York, vol. 46, No. 2, Nov. 15, 2014, pp. 894-902.

Chang et al., "Grain refining of magnesium alloy AZ 31 by rolling", Journal of Materials Processing Technology, Elsevier, NL, 140/1-3, pp. 588-591, Sep. 22, 2003.

Yang Yu et al., "Yang Yu et al., The effects of cold extrusion on grain size refinement and plasticity for magnesium alloy, International Journal of Modern Physics, 23/06, pp. 821-825, Mar. 20, 2009".

Liang S J et al., "microstructure and mechanical properties of Mg-Al-Zn alloy sheet fabricated by cold extrusion", Materials Letters, vol. 62, Sep. 15, 2008, pp. 4009-4011.

Ku He et al., Magnesium alloy preparation and processing technology, May 31, 2007 Metallurgical Industry Press, CN Source Info: pp. 11, 211-212.

* cited by examiner

Schematic View Showing A Method For Extruding Metal
1-Ingot; 2-Extrusion Barrel (Housing); 3-Die Base (Die Support); 4-Die;
5-Extruded Article; 6-Extrusion Axis; 7-Extrusion Barrel (Lining);
8-Extrusion Gasket

MAGNESIUM OR MAGNESIUM ALLOY HAVING ULTRA-HIGH FORMABILITY AT ROOM TEMPERATURE AND MANUFACTURING METHOD THEREOF

CROSS-REFERENCE TO RELATED APPLICATIONS

This application is a 371 U.S. National Phase of PCT International Application No. PCT/CN2018/106867 filed on Sep. 21, 2018, which claims benefit and priority to Chinese patent applicaton no. 201710875802.0 filed on Sep. 25, 2017. Both of the above-referenced applications are incorporated by reference herein in their entireties.

TECHNICAL FIELD

The present disclosure relates to a metal or metal alloy and a method for manufacturing the same, particularly to a metal or metal alloy having good formability and a method for manufacturing the same.

BACKGROUND ART

Magnesium, accounting for 2.7% of the earth crust, is a metal material widely available in our daily life. It may be extracted from ores or sea water. After refining, its purity may be up to 99.8%. In addition, magnesium is the lightest metallic structural material that has been found to date. Its density is only 1.74 g/cm$^3$, which is two thirds of the density of aluminum, and one fourth of the density of steel. This characteristic allows magnesium to be used as a metal in place of aluminum and steel for wide applications in the fields of automobiles, aircrafts and rail vehicles. The use of magnesium alloy may save energy, thereby reducing operational cost. For example, if the weight of an automobile is reduced by 100 kg, its fuel consumption will decrease by 0.38 liter per hundred kilometers, and its emission of $CO_2$ will decrease by 8.7 gram per kilometer. However, the room-temperature formability of section products and flat products of magnesium and magnesium alloy is not high. Due to this limitation, magnesium alloy plates have so far not gained wide industrial applications.

The hard workability of magnesium at room temperature is decided by its nature. The main deformation modes of magnesium include basal slip, prismatic slip, pyramidal slip and crystal twinning. Except for basal slip, the other slip systems are difficult to be activated at room temperature. In processing, gradual formation of a strong basal texture in magnesium makes activation of basal slip increasingly difficult. Activation of crystal twinning depends on whether the grain orientation of magnesium before processing is suitable for the activation of crystal twinning. Even if crystal twinning is activated, the bearable strain is not large, wherein the largest strain is only 8% of the total strain. In contrast, aluminum and aluminum alloy have high room-temperature formability. They can be processed into pop-top cans from aluminum plates at room temperature. In comparison, magnesium and magnesium alloy break at a reduction rate of 30% when rolled at room temperature.

Up to now, addition of appropriate alloy elements has been a main measure for improving the room-temperature formability of magnesium. The reason for this is that the addition of some alloy elements can weaken the texture, or can make activation of the slip systems other than basal slip easier at room temperature. Even so, the room-temperature formability of magnesium is still poor. Despite that grain boundary slip as an additional deformation mode may be activated at room temperature after magnesium is deformed greatly by processing (e.g. equal channel angular pressing), the maximum reduction rate in the compression at room temperature is only 20%. Besides, magnesium alloy samples processed by great deformation generally have small sizes, insufficient for industrial applications.

SUMMARY

One of the objects of the present disclosure is to provide a magnesium having ultra-high room-temperature formability, i.e. ultra-high formability at room temperature, wherein, in view of the problem of poor room-temperature formability of magnesium in the prior art, simple processing means are employed to prepare the magnesium having ultra-high room-temperature formability, so that magnesium which is intrinsically difficult to be deformed achieves good room-temperature formability and can be shaped easily.

To achieve the above object, there is proposed herein a magnesium having ultra-high room-temperature formability, wherein its grain size is ≤2 microns, i.e. having a grain size of 2 microns or less.

After extensive experimental research, the present inventors have discovered that, when the grain size of magnesium is ≤2 microns, magnesium or magnesium alloy traditionally having poor formability obtains ultra-high room-temperature formability, and can be shaped easily. The reason for such an achievement is that the deformation modes of magnesium having coarse grains (grain size being far greater than 2 microns) are intragrain deformations, including dislocation slip and crystal twinning. Due to the influence of the hexagonal structure of magnesium, the intragrain deformation modes are limited, and are not sufficient to endure large plastic deformation. Hence, the coarse grain magnesium has poor room-temperature formability. In the magnesium or magnesium alloy having ultra-high room-temperature formability according to the present disclosure, when the magnesium grain size is ≤2 microns, the main deformation modes of magnesium change from intragrain deformations to grain boundary deformations, for example, grain boundary slip and bodily rotation of grains. In the plastic deformation of magnesium having ultrafine grains (grain size ≤2 microns), these grain boundary deformations provide additional deformation modes. At the same time, as the grain size of magnesium decreases and the grain boundary area increases, dynamic recrystallization in the plastic deformation at room temperature occurs more easily, and the degree of intragrain strain decreases. The large-scale activation of grain boundary deformation modes and dynamic recrystallization at room temperature prevent accumulation of the intragrain strain of the ultrafine grain magnesium to such a degree that breakage occurs. As a result, ultra-high room-temperature formability is obtained.

Further, in the magnesium having ultra-high room-temperature formability according to the present disclosure, its grain size is ≤1 micron.

In addition, another object of the present disclosure is to provide a magnesium alloy having ultra-high room-temperature formability, wherein the magnesium alloy having ultra-high room-temperature formability has good room-temperature formability.

To achieve the above object, there is proposed herein a magnesium alloy having ultra-high room-temperature formability, wherein its grain size is ≤2 microns.

Further, in the magnesium alloy having ultra-high room-temperature formability according to the present disclosure, its grain size is ≤1 micron.

Further, in the magnesium alloy having ultra-high room-temperature formability according to the present disclosure, the magnesium alloy having ultra-high room-temperature formability comprises at least one of aluminum, zinc, calcium, tin, silver, strontium, zirconium and rare earth elements, wherein a total mass percentage of the at least one of aluminum, zinc, calcium, tin, silver, strontium, zirconium and rare earth elements is ≤1.5%.

Accordingly, yet another object of the present disclosure is to provide a method for manufacturing the magnesium having ultra-high room-temperature formability as described above, wherein a magnesium section product made from the magnesium having ultra-high room-temperature formability obtained by this manufacturing method has good ultra-high room-temperature formability.

To achieve the above object, there is proposed herein a method for manufacturing the magnesium having ultra-high room-temperature formability as described above, wherein the magnesium having ultra-high room-temperature formability is processed into a magnesium section product, and wherein the method comprises a step of extruding a raw material at a temperature of 20-150° C. and an extrusion ratio of 10:1-100:1 to obtain the magnesium section product.

After extensive research, the present inventors have discovered that magnesium recrystallizes dynamically in an extrusion process at various temperatures. In this process, a coarse cast structure transforms into a recrystallized structure, and extrusion temperature is a major factor that influences recrystallized grain size. In a conventional extrusion process (wherein a conventional extrusion temperature is generally higher than 300° C.), magnesium grain boundaries migrate readily. After nucleation, dynamically recrystallized grains of magnesium rapidly grow to about 10-100 microns. In the technical solution of the present disclosure, to obtain a structure having grains of 2 microns or less, the extrusion temperature needs to be controlled to induce substantial dynamic recrystallization, but the moving speed of grain boundaries is relatively slow, so as to control the recrystallized grain size.

Hence, in the technical solution of the present disclosure, to obtain a structure having grains of 2 microns or less in the magnesium having ultra-high room-temperature formability, the extrusion temperature is controlled at 20-150° C., and the extrusion ratio is controlled at 10:1-100:1, so as to obtain the magnesium section product having the desired microstructure.

In the above technical solution, the reason why the extrusion ratio is controlled at 10:1-100:1 is that an unduly high extrusion ratio requires an excessive high resistance to the extrusion force which is difficult to be provided by an equipment, while an unduly low extrusion ratio results in insufficient deformation of the extruded material, such that recrystallized grains are not refined sufficiently and cannot obtain a desired grain size.

It's noted that an extrusion ratio represents a ratio of a cross sectional area of a material before extrusion (e.g. a circular cross sectional area of a cylindrical cast bar) to a cross sectional area of the material after the extrusion.

In some embodiments, the extrusion temperature is controlled at 20-80° C. for the reason that the present inventors have discovered after extensive research that the grain size of pure magnesium is about 1.2 microns when the extrusion temperature is decreased to 80° C. When the extrusion temperature is further decreased, or a small amount of an alloy element(s) is added (e.g., at least one of aluminum, zinc, calcium, tin, silver, strontium, zirconium and rare elements, wherein a total mass percentage of the at least one of aluminum, zinc, calcium, tin, silver, strontium, zirconium and rare earth elements is ≤1.5%), the moving speed of the recrystallized grain boundaries will be further slowed, so as to refine the recrystallized structure to 1 micron or less.

Further, in the method for manufacturing the magnesium having ultra-high room-temperature formability according to the present disclosure, the method has an extrusion push rod speed of 0.05 mm/s-50 mm/s.

It's noted that a speed of an extrusion push rod refers to the speed of the extrusion rod moving toward a die during an extrusion process.

Accordingly, still another object of the present disclosure is to provide a method for manufacturing the magnesium having ultra-high room-temperature formability as described above, wherein a magnesium flat product made from the magnesium having ultra-high room-temperature formability obtained by this manufacturing method has good ultra-high room-temperature formability.

To achieve the above object, there is proposed herein a method for manufacturing the magnesium having ultra-high room-temperature formability as described above, wherein the magnesium having ultra-high room-temperature formability is processed into a magnesium flat product, wherein the method comprises the following steps:

(1) extruding a raw material at a temperature of 20-150° C. and an extrusion ratio of 10:1-100:1; and (2) rolling at 20-100° C. to form the magnesium flat product.

In the present disclosure, the submicron structure of the magnesium or magnesium alloy having a grain size of ≤2 microns does not change in a cold rolling process. Hence, it can be rolled into flat products of various specifications/dimensions. However, to prevent growth of grains at high temperatures, the rolling temperature is controlled at 20-100° C.

Further, in the method for manufacturing the magnesium having ultra-high room-temperature formability according to the present disclosure, the method comprises an extrusion push rod speed of 0.05 mm/s-50 mm/s in Step (1).

Further, in the method for manufacturing the magnesium having ultra-high room-temperature formability according to the present disclosure, the magnesium flat product has a thickness of 0.3-4 mm or 0.04-0.3 mm.

In view of the required dimensions of products in practical applications, the thickness of the magnesium flat product in the present disclosure is 0.3-4 mm or 0.04-0.3 mm.

In addition, yet still another object of the present disclosure is to provide a method for manufacturing the magnesium alloy having ultra-high room-temperature formability as described above, wherein a magnesium alloy section product made from the magnesium alloy having ultra-high room-temperature formability obtained by this manufacturing method has good ultra-high room-temperature formability.

To achieve the above object, there is proposed herein a method for manufacturing the magnesium alloy having ultra-high room-temperature formability as described above, wherein the magnesium alloy having ultra-high room-temperature formability is processed into a magnesium alloy section product, and wherein the method comprises a step of extruding a raw material at a temperature of 20-150° C. and an extrusion ratio of 10:1-100:1 to obtain the magnesium alloy section product.

In the above technical solution, the extrusion ratio is controlled at 10:1-100:1 accordingly for the reason that an unduly high extrusion ratio requires an excessive high resistance to the extrusion force which is difficult to be provided by an equipment, while an unduly low extrusion ratio results in insufficient deformation of the extruded material, such that recrystallized grains are not refined sufficiently and cannot obtain a desired grain size.

Further, in the method for manufacturing the magnesium alloy having ultra-high room-temperature formability according to the present disclosure, an extrusion push rod has a speed of 0.05 mm/s-50 mm/s.

In addition, yet still another object of the present disclosure is to provide a method for manufacturing the magnesium alloy having ultra-high room-temperature formability as described above, wherein a magnesium alloy flat product made from the magnesium alloy having ultra-high room-temperature formability obtained by this manufacturing method has good ultra-high room-temperature formability.

To achieve the above object, there is proposed herein a method for manufacturing the magnesium alloy having ultra-high room-temperature formability as described above, wherein the magnesium alloy having ultra-high room-temperature formability is processed into a magnesium alloy flat product, wherein the method comprises the following steps:

(1) extruding a raw material at a temperature of 20-150° C. and an extrusion ratio of 10:1-100:1; and (2) rolling at 20-100° C. to form the magnesium alloy flat product.

Further, in the method for manufacturing the magnesium alloy having ultra-high room-temperature formability according to the present disclosure, the method comprises an extrusion push rod speed of 0.05 mm/s-50 mm/s in Step (1).

Further, in the method for manufacturing the magnesium alloy having ultra-high room-temperature formability according to the present disclosure, the magnesium alloy flat product has a thickness of 0.3-4 mm or 0.04-0.3 mm.

In the above stated manufacturing methods, the "raw material" used for manufacturing magnesium having ultra-high room-temperature formability refers to a "magnesium raw material" which is an elemental magnesium metal that has neither a grain size of ≤2 microns nor excellent ultra-high formability as desired; and the "raw material" used for manufacturing magnesium alloy having ultra-high room-temperature formability refers to a "magnesium alloy raw material", wherein the magnesium alloy raw material is an alloy formed from metallic magnesium and the alloy element(s) (at least one of aluminum, zinc, calcium, tin, silver, strontium, zirconium and rare earth elements, wherein a total mass percentage of the at least one of aluminum, zinc, calcium, tin, silver, strontium, zirconium and rare earth elements is ≤1.5%), and the magnesium alloy raw material has neither a grain size of ≤2 microns nor excellent ultra-high formability as desired. Depending on the specific die and the shape of the finished product, the magnesium raw material or the magnesium alloy raw material may have any desirable shape, such as a cylindrical, cubic or cuboid ingot.

After the above indicated "raw material" is extruded at a temperature of 20-150° C. and an extrusion ratio of 10:1-100:1, a magnesium section product or a magnesium alloy section product is obtained. As described above, after the extrusion process, the magnesium section product or magnesium alloy section product has the desired ultra-high room-temperature formability. The processing means decides that the resulting magnesium or magnesium alloy having ultra-high room-temperature formability is in a form of section product. Therefore, the terms "section product", "magnesium section product" and "magnesium alloy section product" used herein refer to a magnesium having ultra-high room-temperature formability or a magnesium alloy having ultra-high room-temperature formability that has the desired ultra-high room-temperature formability and is in a form of section product after extrusion processing.

The extrusion operation in the present disclosure is performed using a conventional extrusion apparatus, wherein the improvement made by the present disclosure lies in the elaborate design of the temperature and extrusion ratio in the extrusion operation. The extrusion apparatus may be selected and modified as desired, with the proviso that the temperature and extrusion required by the present disclosure can be fulfilled. In the present disclosure, the temperature of "20-150° C." is the temperature of the magnesium/magnesium alloy being processed by extrusion, and the temperature is achieved by heating the magnesium/magnesium alloy, or heating the magnesium alloy and the extrusion barrel, die and push rod of the surrounding extrusion apparatus all together. In one embodiment of the present disclosure, the push rod, extrusion barrel and die are all made from die steel. A die cavity, which may be determined in light of the specific requirements of a product, comprises a chamber and a through hole extending through the die, wherein the chamber is used to contain a magnesium raw material or a magnesium alloy raw material, and the through hole may have a tapering or constant cross section size. The extrusion ratio defined specifically by the present disclosure may be obtained by adjusting the cross section size of the through hole and the cross section size of the magnesium raw material or the magnesium alloy raw material. The push rod has an end portion that matches the extrusion barrel, the chamber of the die and the size and shape of the magnesium raw material or magnesium alloy raw material, and is used to push and squeeze the magnesium raw material or magnesium alloy raw material through the extrusion barrel, the chamber of the die and the through hole in the extrusion process, so as to obtain the desired ultra-high room-temperature formability while a section product is formed.

After the magnesium section product or magnesium alloy section product having ultra-high room-temperature formability is obtained using the above extrusion operation, it may be optionally further rolled at 20-100° C. to form a magnesium flat product.

The magnesium or magnesium alloy having ultra-high room-temperature formability according to the present disclosure fundamentally solves the problem of the magnesium being difficult to be molded at room temperature. In addition, the method for manufacturing the magnesium or magnesium alloy having ultra-high room-temperature formability has the advantages of low cost and high production efficiency, and may be put into industrial manufacture directly.

DETAILED DESCRIPTION

Figure 1:
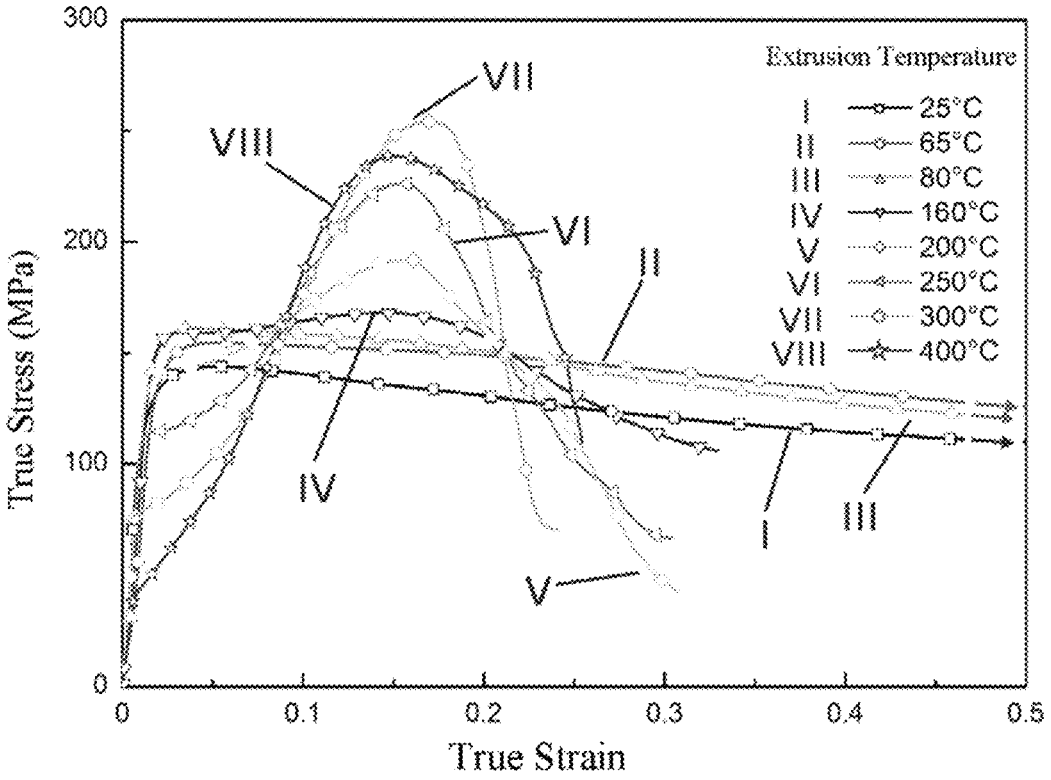
FIG. 1 shows true stress—true strain curves of magnesium having ultra-high room-temperature formability in Examples 1, 3 and 7 and conventional magnesium in Comparative Examples 1-5 in room-temperature compression tests at different temperatures.

The magnesium or magnesium alloy having ultra-high room-temperature formability and the manufacture method thereof according to the present disclosure will be further explained and illustrated with reference to the specific examples and the accompanying drawings. Nonetheless, the explanation and illustration are not intended to unduly limit the technical solution of the disclosure.

Examples 1-20 and Comparative Examples 1-5

A section product of magnesium or magnesium alloy having ultra-high room-temperature formability was manufactured by a process comprising the following step: extruding a raw material at a temperature of 20-150° C., an extrusion ratio of 10:1-100:1 and an extrusion push rod speed of 0.05 mm/s-50 mm/s to obtain the magnesium section product.

A flat product of magnesium or magnesium alloy having ultra-high room-temperature formability was manufactured by a process comprising the following steps:

(1) extruding a raw material at a temperature of 20-150° C., an extrusion ratio of 10:1-100:1 and an extrusion push rod speed of 0.05 mm/s-50 mm/s; and (2) rolling at 20-100° C. to form the magnesium flat product.

The thickness of the magnesium flat product was 0.3 mm-4 mm or 0.04 mm-0.3 mm.

Table 1 lists the specific process parameters for the method for manufacturing the magnesium or magnesium alloy having ultra-high room-temperature formability in Examples 1-12.

TABLE 1

| No. | Product Type | Extrusion temperature (° C.) | Extrusion Ratio | Extrusion Push Rod Speed (mm/s) | Rolling Temperature (° C.) | Flat Product Thickness (mm) |
|---|---|---|---|---|---|---|
| Ex. 1 | Pure magnesium section product | 25 | 19 | 0.1 | — | — |
| Ex. 2 | Pure magnesium section product | 25 | 40 | 0.1 | — | — |
| Ex. 3 | Pure magnesium section product | 65 | 19 | 0.1 | — | — |
| Ex. 4 | Pure magnesium section product | 65 | 40 | 0.1 | — | — |
| Ex. 5 | Pure magnesium flat product | 65 | 19 | 0.1 | 25 | 1 |
| Ex. 6 | Pure magnesium flat product | 65 | 40 | 0.1 | 25 | 4 |
| Ex. 7 | Pure magnesium section product | 80 | 19 | 0.1 | — | — |
| Ex. 8 | Pure magnesium section product | 80 | 40 | 0.1 | — | — |
| Ex. 9 | Pure magnesium flat product | 80 | 19 | 0.1 | 25 | 1 |
| Ex. 10 | Pure magnesium flat product | 80 | 19 | 0.1 | 25 | 0.12 |
| Ex. 11 | Pure magnesium flat product | 80 | 40 | 0.1 | 25 | 1 |
| Ex. 12 | Pure magnesium flat product | 80 | 40 | 0.1 | 25 | 0.04 |
| Ex. 13 | Mg—0.5Al—0.5Zn magnesium alloy section product | 100 | 100 | 50 | — | — |
| Ex. 14 | Mg—0.1Zn—0.1Ca—0.4Zr magnesium alloy section product | 60 | 50 | 0.05 | — | — |
| Ex. 15 | Mg—1.0Zn—0.4Ca—0.1Ag magnesium alloy section product | 20 | 10 | 0.1 | — | — |
| Ex. 16 | Mg—1Zn-0.5RE rare earth magnesium alloy section product | 150 | 100 | 0.05 | — | — |
| Ex. 17 | Mg—0.3Al—0.1Zn magnesium alloy flat product | 60 | 50 | 0.5 | 20 | 4 |
| Ex. 18 | Mg—0.5Sn—0.1Zn magnesium alloy flat product | 50 | 10 | 0.05 | 50 | 0.3 |
| Ex. 19 | Mg—1.0Al—0.5Sr magnesium alloy flat product | 50 | 80 | 10 | 80 | 0.04 |
| Ex. 20 | Mg—0.8Al—0.1Zn-0.6RE rare earth magnesium alloy flat product | 150 | 10 | 50 | 100 | 0.2 |

Table 2 lists the grain sizes of the magnesium or magnesium alloy having ultra-high room-temperature formability in Examples 1-20.

TABLE 2

| No. | Grain Size (μm) |
|---|---|
| Ex. 1 | 0.8 |
| Ex. 2 | 0.8 |
| Ex. 3 | 1.1 |
| Ex. 4 | 1.2 |
| Ex. 5 | 1.2 |
| Ex. 6 | 1.2 |
| Ex. 7 | 1.3 |
| Ex. 8 | 1.3 |
| Ex. 9 | 1.2 |
| Ex. 10 | 1.4 |
| Ex. 11 | 1.2 |

TABLE 2-continued

| No. | Grain Size (μm) |
|---|---|
| Ex. 12 | 1.4 |
| Ex. 13 | 0.5 |
| Ex. 14 | 1.2 |
| Ex. 15 | 1.8 |
| Ex. 16 | 2 |
| Ex. 17 | 1.5 |
| Ex. 18 | 0.1 |
| Ex. 19 | 0.3 |
| Ex. 20 | 0.8 |

In order to verify the properties of the magnesium or magnesium alloy having ultra-high room-temperature formability according to the present application, it was extruded at an extrusion ratio of 19:1 at different temperatures, wherein the extrusion temperature was room temperature (25° C.) for Examples 1-2, 65° C. for Examples 3-6, 80° C. for Examples 7-12, 160° C. for Comparative Example 1, 200° C. for Comparative Example 2, 250° C. for Comparative Example 3, 300° C. for Comparative Example 4, and 400° C. for Comparative Example 5. Before extrusion, a graphite coating was sprayed on the ingot for Examples 1-12 and Comparative Examples 1-5 and the die to reduce friction force during the extrusion process. After extrusion, Examples 1-4, 7 and Comparative Examples 1-5 were cooled with water rapidly, followed by room-temperature compression testing and cold rolling. In the compression testing, the compressing rate was 0.6 mm/min; in the cold rolling process, the reduction per pass was 0.1 mm, and the roll speed was 15 m/min.

It was observed from the testing that, after the pure magnesium cast ingot in Examples 1-4, 7 and 8 according to the present disclosure was extruded, the polycrystalline magnesium section products obtained ultra-high room-temperature formability. In comparison, when the pure magnesium cast ingot in Comparative Examples 1-5 was extruded and processed into section products, the section products exhibits poor room-temperature formability. When Comparative Examples 1-5 were subjected to compression tests at room temperature, the maximum reduction rate was 20-30%, and the phenomenon of work hardening was obvious. In addition, when processed into magnesium section products, the magnesium having ultra-high room-temperature formability in the various Examples according to the present disclosure didn't break in compression at room temperature, and work hardening didn't occur. The test samples softened as the strain increased gradually. This softening suggests that slip and crystal twinning are not the major deformation modes in the compression at room temperature. This softening is generally related with grain boundary slip and/or dynamic recrystallization. In magnesium alloy, grain boundary slip and dynamic recrystallization generally occur at high temperatures instead of room temperature.

FIG. 1 shows the true stress—true strain reduction rate curves of magnesium having ultra-high formability at room temperature in Examples 1, 3 and 7 and conventional magnesium in Comparative Examples 1-5 in room-temperature compression tests at different temperatures. As shown by FIG. 1, Curves I to VIII demonstrate the true strain under true stress of the magnesium having ultra-high room-temperature formability in Examples 1, 3, 7 and the conventional magnesium in Comparative Examples 1-5.

Figure 2:
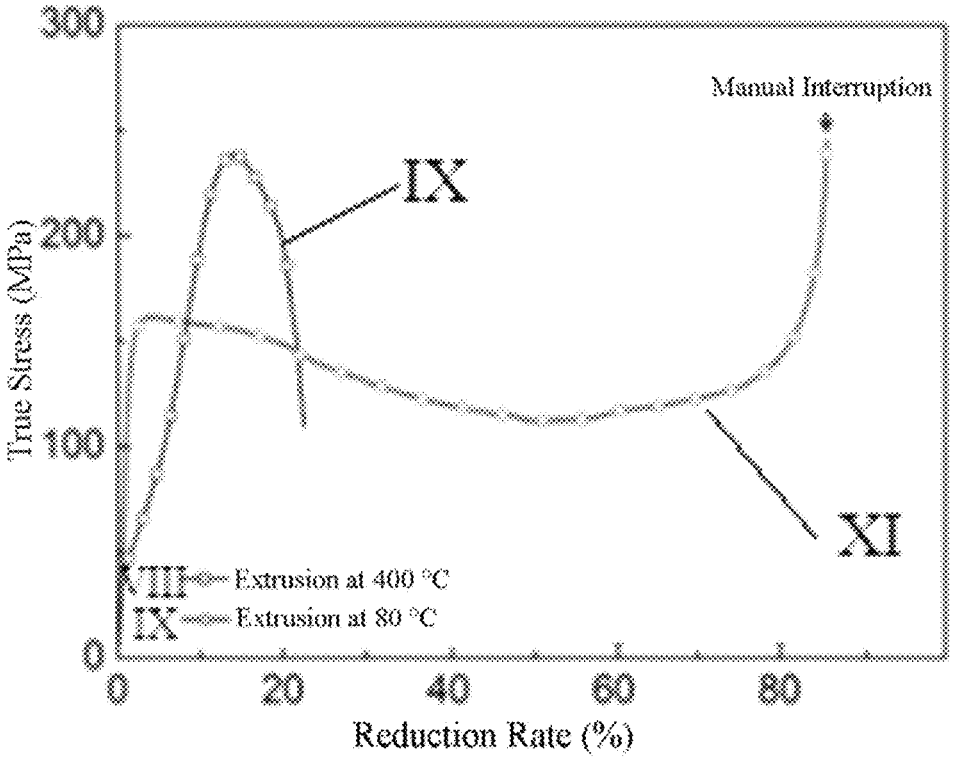
FIG. 2 shows true stress—reduction rate curves of magnesium having ultra-high room-temperature formability in Example 7 and conventional magnesium in Comparative Example 5 in room-temperature compression tests.

FIG. 2 shows true stress—reduction rate curves of magnesium having ultra-high room-temperature formability in Example 7 and conventional magnesium in Comparative Example 5 in room-temperature compression tests. As shown by FIG. 2, Curve XI for Example 7 and Curve IX for Comparative Example 5 demonstrate the variation of the reduction rate under different true stresses in the room-temperature compression tests.

Figure 3:
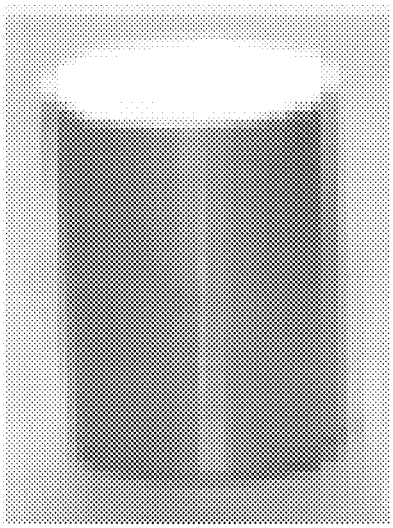
FIG. 3 is a photograph showing a conventional magnesium sample in Comparative Example 5 before tested in the room-temperature compression test.
Figure 4:
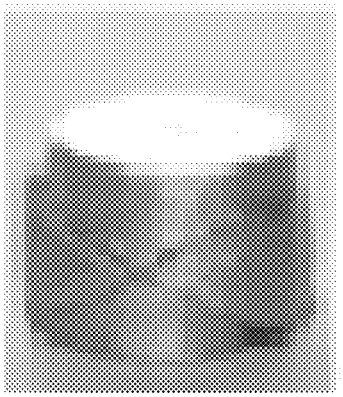
FIG. 4 is a photograph showing the conventional magnesium sample in Comparative Example 5 after tested in the room-temperature compression test.
Figure 5:
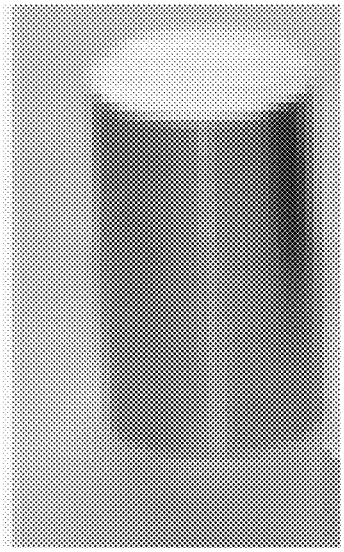
FIG. 5 is a photograph showing a sample of magnesium having ultra-high room-temperature formability in Example 7 before tested in the room-temperature compression test.
Figure 6:
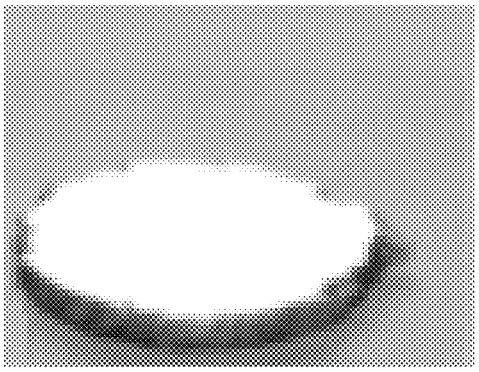
FIG. 6 is a photograph showing the sample of magnesium having ultra-high room-temperature formability in Example 7 after tested in the room-temperature compression test.

FIGS. 3 to 6 show schematically the change in morphology of the magnesium having ultra-high room-temperature formability in Example 7 and the conventional magnesium in Comparative Example 5 before and after the room-temperature compression tests. FIG. 3 is a photograph showing a conventional magnesium sample of Comparative Example 5 before tested in the room temperature compression test. FIG. 4 is a photograph showing the conventional magnesium sample of Comparative Example 5 after tested in the room temperature compression test. FIG. 5 is a photograph showing a sample of magnesium having ultra-high room-temperature formability in Example 7 before tested in the room temperature compression test. FIG. 6 is a photograph showing the sample of magnesium having ultra-high room-temperature formability in Example 7 after tested in the room temperature compression test.

As shown by FIGS. 3 and 4, the conventional magnesium in Comparative Example 5 broke apparently in the room-temperature compression test. In contrast, as shown by FIGS. 5 and 6, the magnesium having ultra-high room-temperature formability in Example 7 according to the present disclosure didn't break in the test, and the reduction rate was significantly larger than that of Comparative Example 5. Moreover, work hardening didn't occur for Example 7.

As can thus be seen, the room-temperature formability of the magnesium having ultra-high room-temperature formability in Example 7 according to the present disclosure is notably superior over the conventional magnesium in Comparative Example 5.

FIGS. 7 to 16 are used to verify the bending effect of the magnesium having ultra-high room-temperature formability in Example 8 and the conventional magnesium in Comparative Example 5 under different states.

The magnesium having ultra-high room-temperature formability in Example 8 was extruded into a magnesium square bar, and rolled from an extruded state having a thickness of 3 mm into a magnesium flat product having a thickness of 1 mm. The resulting magnesium flat product having ultra-high room-temperature formability didn't crack at any edge. This magnesium flat product was further rolled into a magnesium flat product having a thickness of 0.12 mm. At this time, the rolling of the magnesium flat product from 3 mm to 0.12 mm led to a reduction rate of 96% and a true strain of 3.2, much greater than the maximum cold rolling reduction rate (30%) and the corresponding true strain of 0.4 of the conventional magnesium. The magnesium flat product having a thickness of 0.12 mm was cut into two sections which were bent into "m" and "g" shapes. As can thus be seen, when processed into a section or flat product, the magnesium having ultra-high room-temperature formability in Example 8 according to the present disclosure exhibited excellent room-temperature formability, and surface cracking didn't occur easily.

Figure 7:
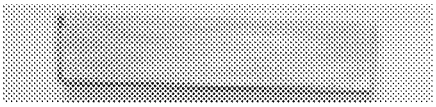
FIG. 7 is a photograph showing a sample of magnesium having ultra-high room-temperature formability in Example 8 in an extruded state.
Figure 8:
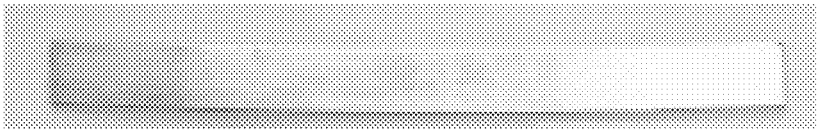
FIG. 8 is a photograph showing the sample of magnesium having ultra-high room-temperature formability in Example 8 when processed into a 1 mm thick magnesium flat product.
Figure 9:
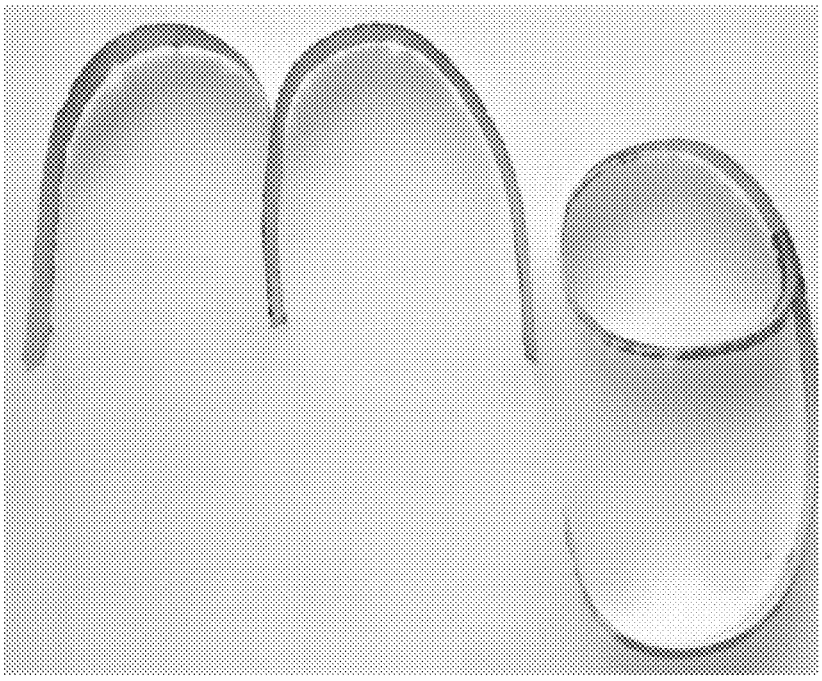
FIG. 9 shows the bending effect of the magnesium having ultra-high room-temperature formability in Example 8 when processed into a 0.12 mm thick magnesium flat product.
Figure 10:
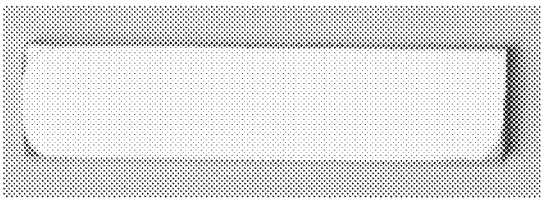
FIG. 10 is a photograph showing the conventional magnesium sample in Comparative Example 5 in an extruded state.
Figure 11:
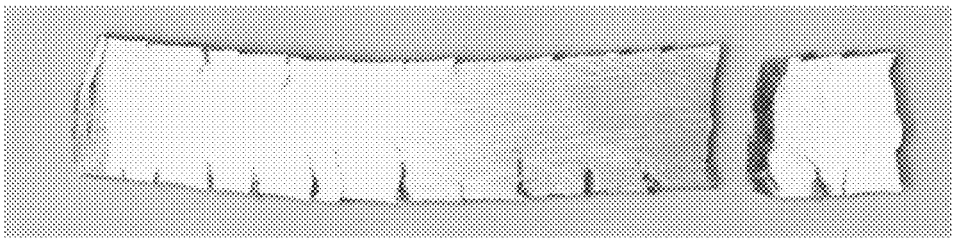
FIG. 11 is a photograph showing the conventional magnesium sample in Comparative Example 5 when cold rolled to 33%.

FIG. 7 is a photograph showing a sample of magnesium having ultra-high room-temperature formability in Example 8 in an extruded state. FIG. 8 is a photograph showing the sample of magnesium having ultra-high room-temperature formability in Example 8 when processed into a 1 mm thick magnesium flat product. FIG. 9 shows the bending effect of the sample of magnesium having ultra-high room-temperature formability in Example 8 when processed into a 0.12 mm thick magnesium flat product. FIG. 10 is a photograph showing a conventional magnesium sample in Comparative Example 5 in an extruded state. FIG. 11 is a photograph showing the conventional magnesium sample in Comparative Example 5 when cold rolled to 33%.

As can be seen from the comparison of FIG. 8 and FIG. 11, when the conventional magnesium sample in Comparative Example 5 was cold rolled to 33%, a good number of cracks generated at the edges, and the sample broke. In contrast, the magnesium having ultra-high room-temperature formability in Example 8 according to the present disclosure didn't crack at the edges, nor did it break.

To further verify the ultra-high room-temperature formability of the Examples in the present disclosure, the magnesium having ultra-high room-temperature formability in Example 8 was processed into a 1 mm thick magnesium flat product and bent. No breaking occurred after a 180° bend.

Figure 12:
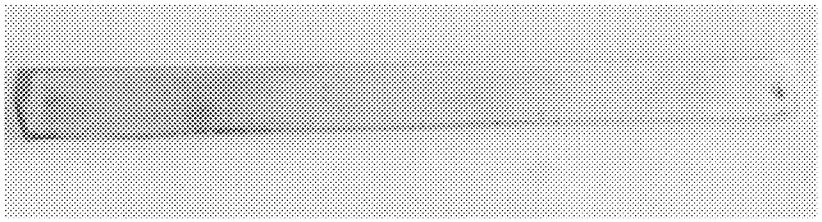
FIG. 12 is a photograph showing the sample of magnesium having ultra-high room-temperature formability in Example 8 after processed into a 1 mm thick magnesium flat product but before being bent.
Figure 13:
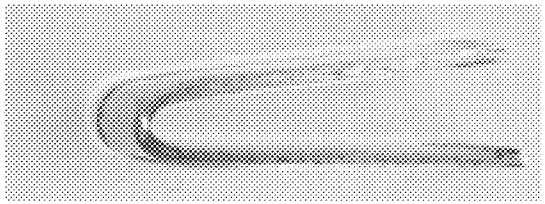
FIG. 13 is a photograph showing the sample of magnesium having ultra-high room-temperature formability in Example 8 after processed into a 1 mm thick magnesium flat product and being bent.

See FIGS. 12 and 13 for the bending of the 1 mm thick magnesium flat product obtained by processing the magnesium having ultra-high room-temperature formability in Example 8 according to the present disclosure. FIG. 12 is a photograph showing the sample of magnesium having ultra-high room-temperature formability in Example 8 after processed into a 1 mm thick magnesium flat product but before being bent. FIG. 13 is a photograph showing the sample of magnesium having ultra-high room-temperature formability in Example 8 after processed into a 1 mm thick magnesium flat product and being bent.

In addition, after the magnesium having ultra-high room-temperature formability in Example 8 was processed into a 0.12 mm thick magnesium flat product, the magnesium flat product could be bent twice without cracks visible to the naked eye after unfolded.

Figure 14:
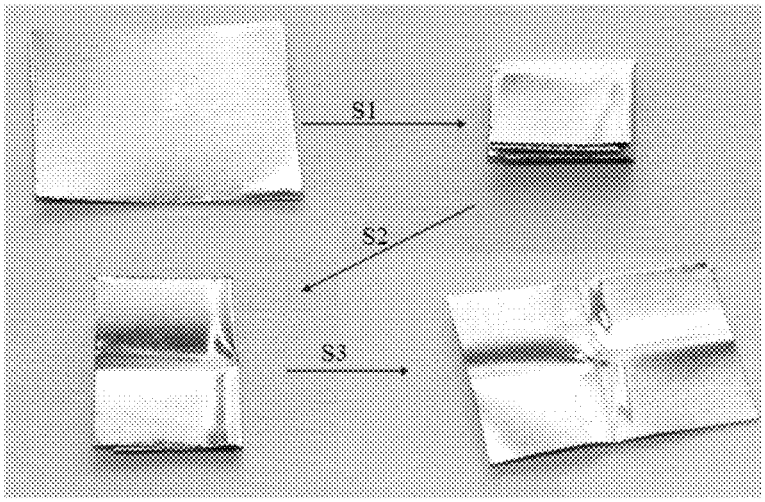
FIG. 14 shows schematically the bending effect of the magnesium having ultra-high room-temperature formability in Example 8 when processed into a 0.12 mm thick magnesium flat product.

See FIG. 14 for the bending of the 0.12 mm thick magnesium flat product obtained by processing the magnesium having ultra-high room-temperature formability in Example 8 according to the present disclosure. FIG. 14 shows schematically the bending effect of the sample of magnesium having ultra-high room-temperature formability in Example 8 when processed into a 0.12 mm thick magnesium flat product. As shown by FIGS. 14, S1, S2 and S3 in the figure represent different operations respectively, wherein S1 represents double folding, S2 represents first unfolding, and S3 represents second unfolding.

As compared with the Examples according to the present disclosure, when the conventional magnesium in Comparative Example 5 was processed into a 1 mm thick magnesium flat product and bent, cracking occurred when it was bent to 95°; when the conventional magnesium in Comparative Example 5 was processed into a 0.12 mm thick magnesium flat product, obvious cracking was observed when it was bent only once and then unfolded.

Figure 15:
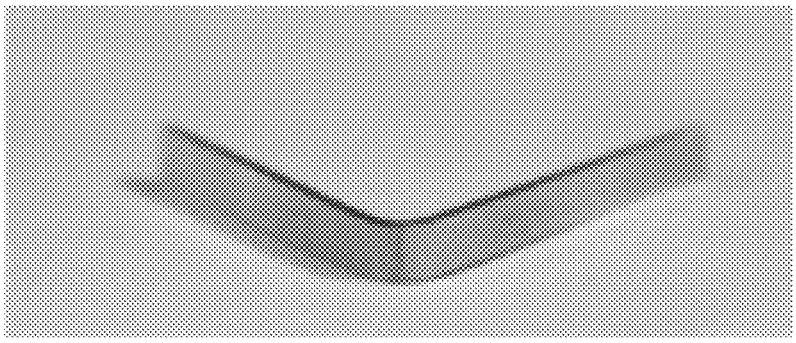
FIG. 15 is a photograph showing the sample of conventional magnesium in Comparative Example 5 after processed into a 1 mm thick magnesium flat product and being bent.
Figure 16:
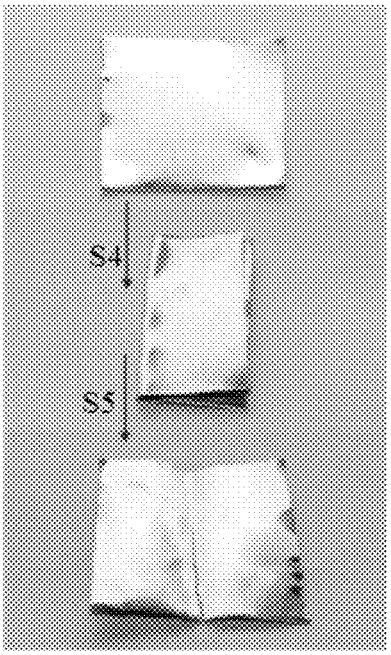
FIG. 16 shows the bending effect of the conventional magnesium in Comparative Example 5 when processed into a 0.12 mm thick magnesium flat product.

See FIG. 15 for the bending of the 1 mm thick magnesium flat product obtained by processing the conventional magnesium in Comparative Example 5. See FIG. 16 for the bending of the 0.12 mm thick magnesium flat product obtained by processing the conventional magnesium in Comparative Example 5. FIG. 15 is a photograph showing the sample of the conventional magnesium in Comparative Example 5 after processed into a 1 mm thick magnesium flat product and bent. FIG. 16 shows the bending effect of the conventional magnesium in Comparative Example 5 when processed into a 0.12 mm thick magnesium flat product. As shown by FIG. 16, S4 represents single bending, and S5 represents unfolding.

As can be seen from FIGS. 7 to 16, the magnesium having ultra-high room-temperature formability in the Examples according to the present disclosure has overturned the traditional knowledge that magnesium is difficult to be processed at room temperature. The ultra-high room-temperature formability is obtained by an extrusion process, and can be maintained after a great deal of cold deformation.

In order to reveal the reason why the magnesium has ultra-high formability at room temperature, the inventors characterized the microstructures of the extruded samples of the magnesium in Comparative Example 5 and the magnesium having ultra-high room-temperature formability in Example 7. These two samples consist of equiaxed crystals, and both had strong textures. The average grain diameters of Comparative Example 5 and Example 7 were 82 μm and 1.3 μm respectively. After Comparative Example 5 extruded at 400° C. was compressed or rolled by 20% at room temperature, the average grain diameter of Comparative Example 5 was reduced to 56-61 μm due to the generation of twin crystals. Completely differently, after Example 7 according to the present disclosure was compressed or rolled by 50% at room temperature, neither the size nor the shape of the grains had any obvious change. Even if the microstructure of the sample was characterized from different angles, the average grain diameter of the Example according to the present disclosure was 1.1-1.2 μm in all cases. After the cold deformation, the texture of Example 7 got slightly stronger.

In addition, even if the sample of Example 7 was cold rolled to a thickness of 0.12 mm, the size and distribution of the grains were still very similar to those in the extruded state. Besides, the deformation amount of the extruded sample of Example 7 was 50%, far greater than the deformation amount of 20% of the extruded sample of Comparative Example 5, but the intragrain misorientation of the extruded sample of Example 7 after deformed by 50% was far less than the intragrain misorientation of the extruded sample of Comparative Example 5 after deformed by 20%. These phenomena indicate that the intragrain deformation of Example 7 according to the present disclosure was very small in the deformation at room temperature.

See FIGS. 10 to 12 for the microstructural changes of Comparative Example 5 and Example 7. See FIG. 13 for the microstructure of the 0.12 mm thick magnesium flat product obtained by processing Example 7.

Figure 17:
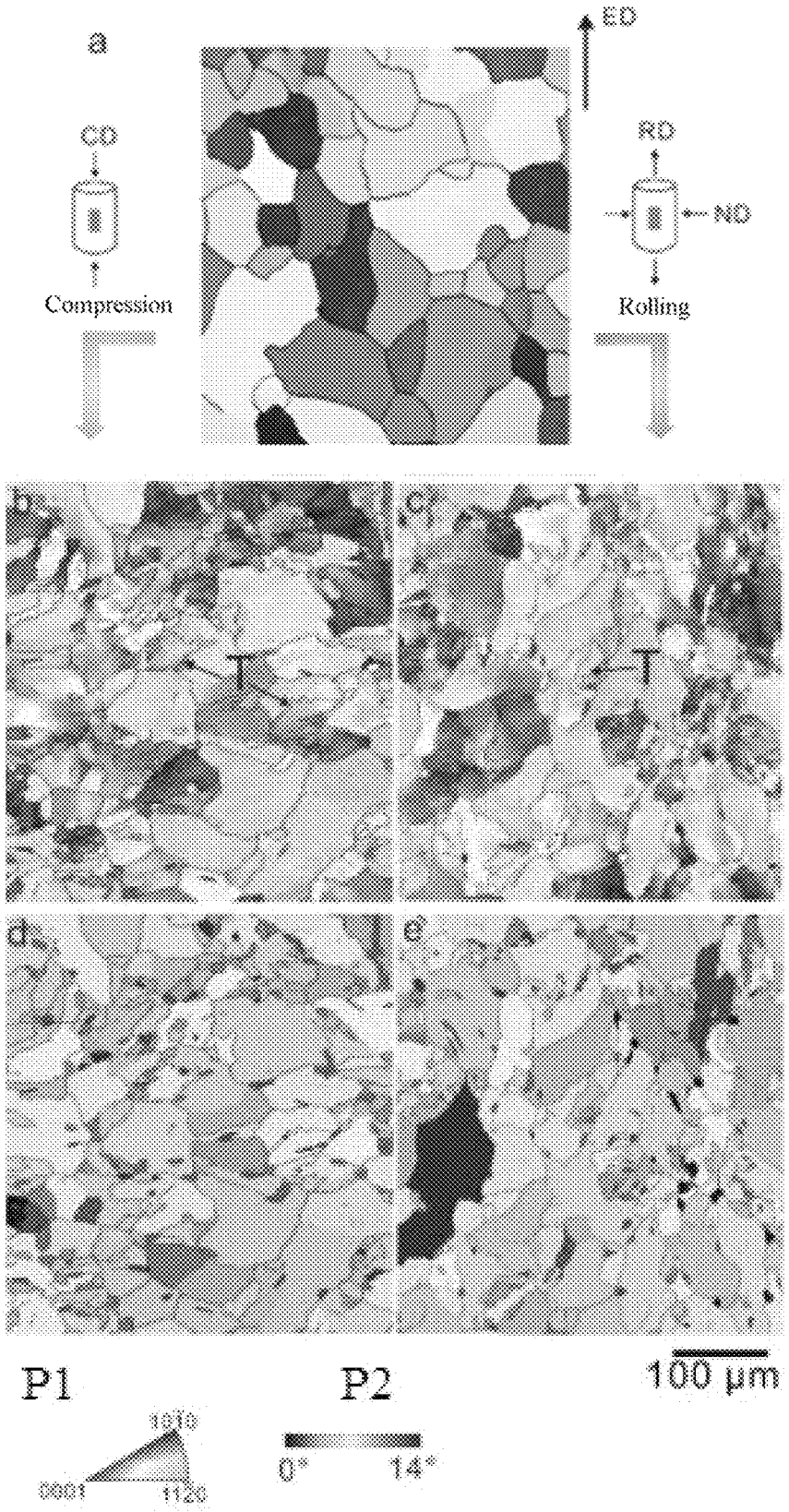
FIG. 17 shows images of electron backscatter diffraction (EBSD) and grain orientation spread (GOS) maps of the conventional magnesium in Comparative Example 5.
Figure 18:
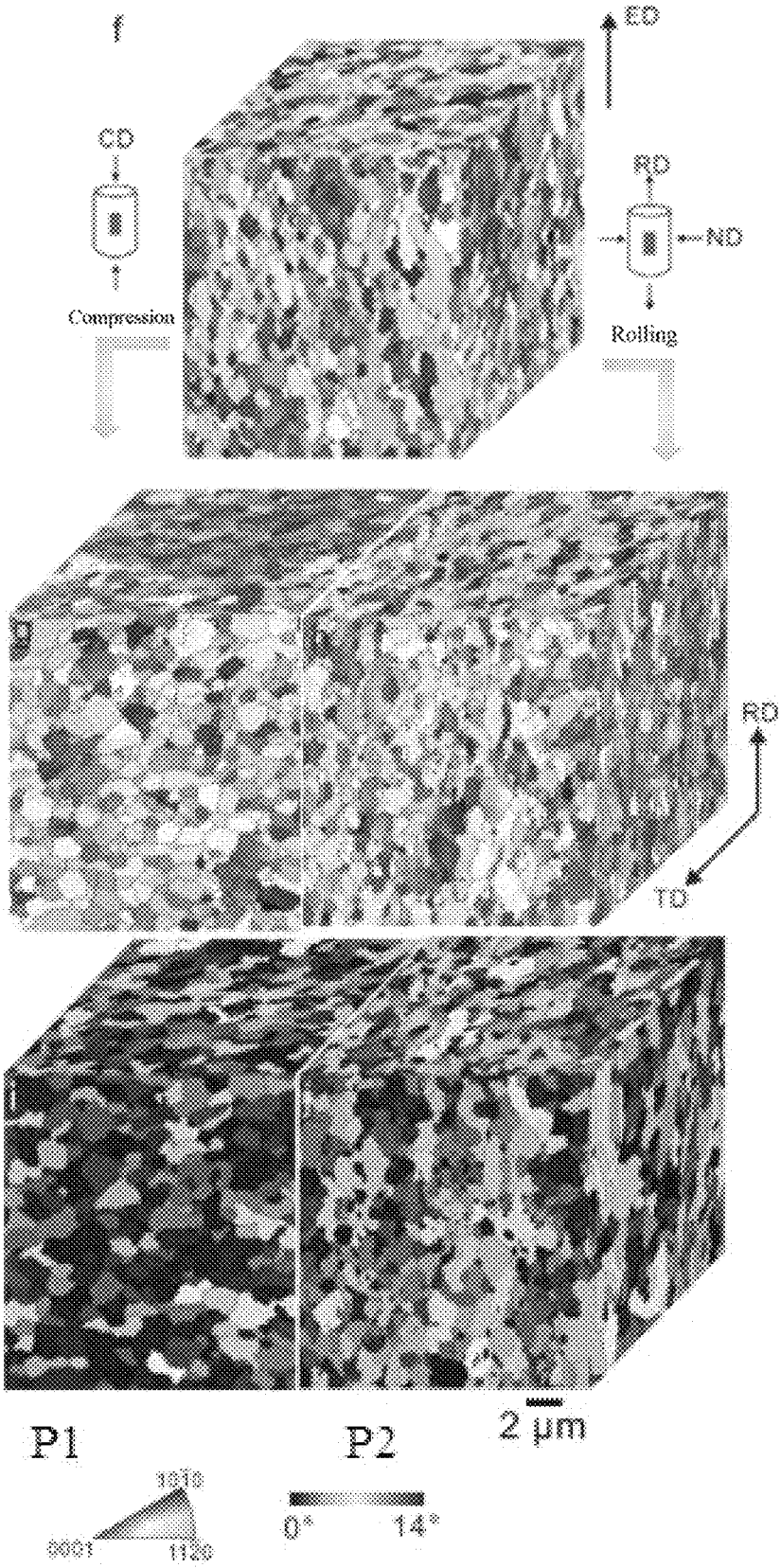
FIG. 18 shows images of electron backscatter diffraction (EBSD) and grain orientation spread (GOS) maps of the magnesium having ultra-high room-temperature formability in Example 7.

FIG. 17 shows images of electron backscatter diffraction (EBSD) and grain orientation spread (GOS) maps of the conventional magnesium in Comparative Example 5. FIG. 18 shows images of electron backscatter diffraction (EBSD) and grain orientation spread (GOS) maps of the magnesium having ultra-high room-temperature formability in Example 7.

As shown by FIG. 17, a in this figure illustrates schematically the grain shape and size of Comparative Example 5 in an extruded state; b in this figure illustrates the grain shape and size of Comparative Example 5 after being compressed by 20% at room temperature; c in this figure illustrates the grain shape and size of Comparative Example 5 after cold rolled by 20%; d in this figure illustrates the intragrain misorientation of Comparative Example 5 after compression at room temperature; and e in this figure illustrates the intragrain misorientation of Comparative Example 5 after cold rolling. T in the figure indicates the position where twin crystals arise.

As shown by FIG. 18, f in this figure illustrates schematically the grain shape and size of Example 7 in an extruded state; g in this figure illustrates the grain shape and size of Example 7 after being compressed by 50% at room temperature; h in this figure illustrates the grain shape and size of Example 7 after cold rolled by 50%; i in this figure illustrates the intragrain misorientation of Example 7 after compression at room temperature; and j in this figure illustrates the intragrain misorientation of Example 7 after cold rolling.

Figure 19:
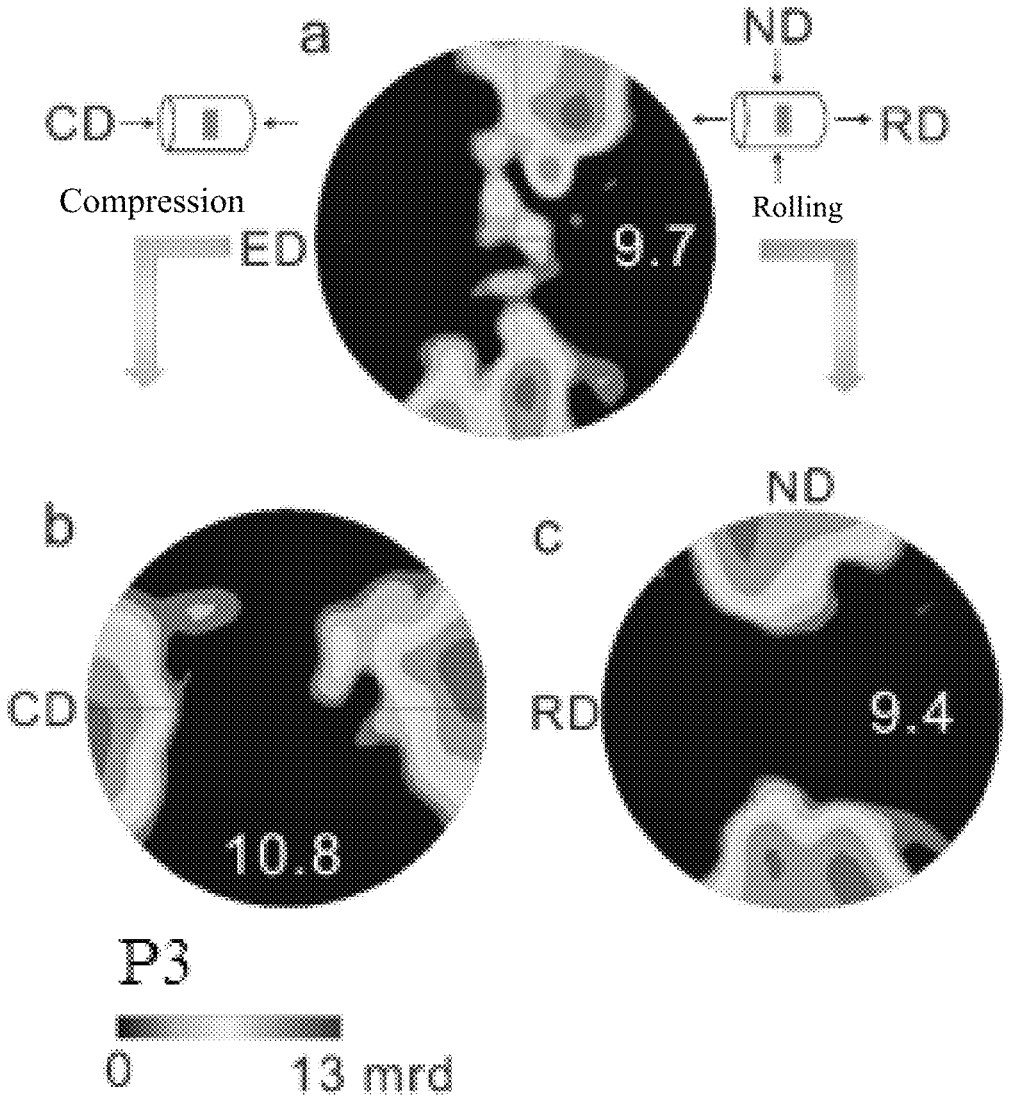
FIG. 19 shows schematically (0001) pole figures of the textures in FIG. 17.
Figure 20:
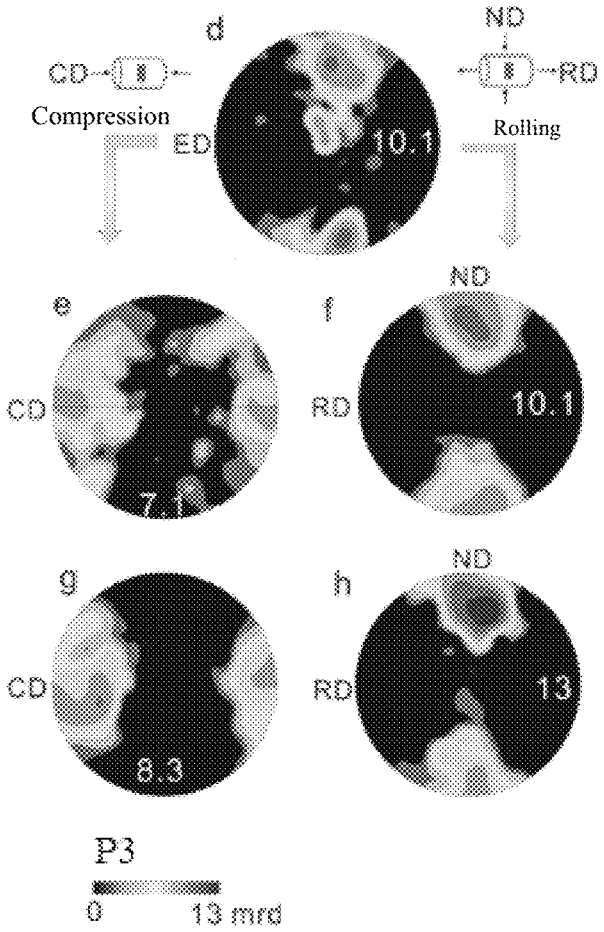
FIG. 20 shows schematically (0001) pole figures of the textures in FIG. 18.

FIG. 19 shows schematically (0001) pole figures of the textures in FIG. 17. FIG. 20 shows schematically (0001) pole figures of the textures in FIG. 18.

As shown by FIG. 19, a in this figure illustrates the texture of Comparative Example 5 in an extruded state; b in this figure illustrates the texture of Comparative Example 5 after being compressed by 20% at room temperature; and c in this figure illustrates the texture of Comparative Example 5 after cold rolled by 20%.

As shown by FIG. 20, d in this figure illustrates the texture of Example 7 in an extruded state; e in this figure illustrates the texture of Example 7 after being compressed by 20% at room temperature; f in this figure illustrates the texture of Example 7 after cold rolled by 20%; g in this figure illustrates the texture of Example 7 after being compressed by 50% at room temperature; and h in this figure illustrates the texture of Example 7 after cold rolled by 50%.

Figure 21:
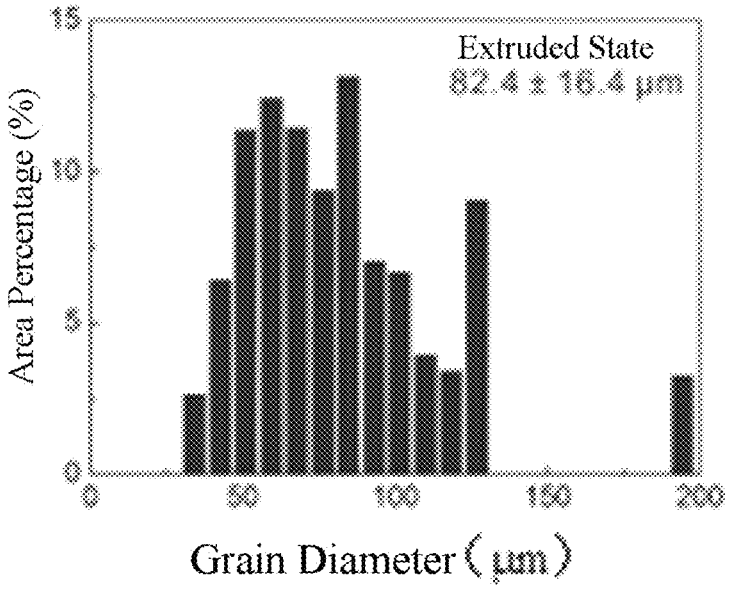
FIG. 21 shows a bar chart of grain size distribution of the conventional magnesium in Comparative Example 5 in an extruded state.
Figure 22:
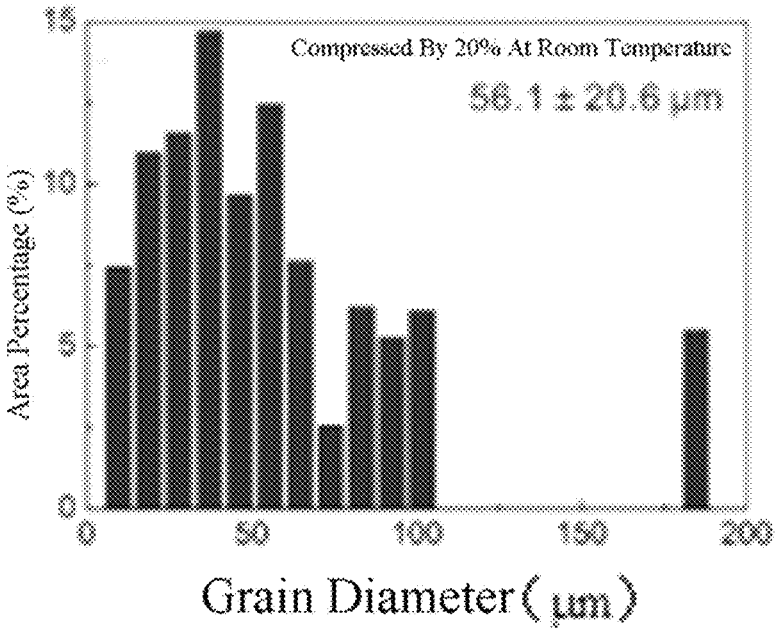
FIG. 22 shows a bar chart of grain size distribution of the conventional magnesium in Comparative Example 5 compressed by 20% at room temperature.
Figure 23:
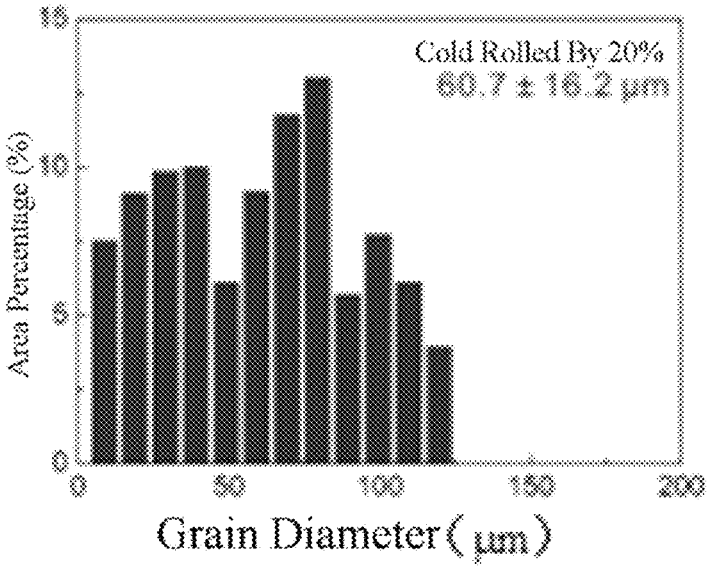
FIG. 23 shows a bar chart of grain size distribution of the conventional magnesium in Comparative Example 5 after cold rolled by 20%.

FIG. 21 shows a bar chart of grain size distribution of the conventional magnesium in Comparative Example 5 in an extruded state. FIG. 22 shows a bar chart of grain size distribution of the conventional magnesium in Comparative Example 5 compressed by 20% at room temperature. FIG. 23 shows a bar chart of grain size distribution of the conventional magnesium in Comparative Example 5 after cold rolled by 20%.

Figure 24:
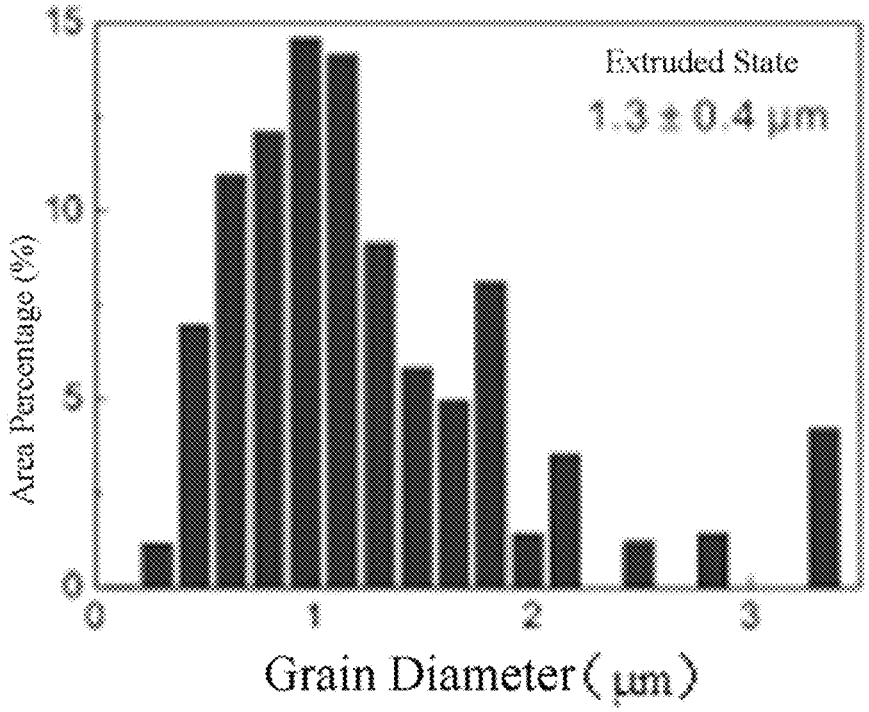
FIG. 24 shows a bar chart of grain size distribution of the magnesium having ultra-high room-temperature formability in Example 7 in an extruded state.
Figure 25:
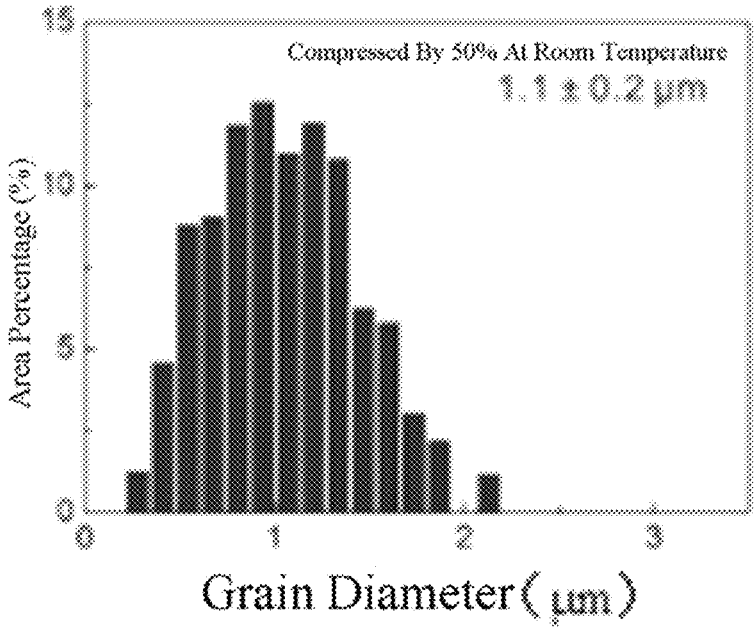
FIG. 25 shows a bar chart of grain size distribution of the magnesium having ultra-high room-temperature formability in Example 7 compressed by 50% at room temperature.
Figure 26:
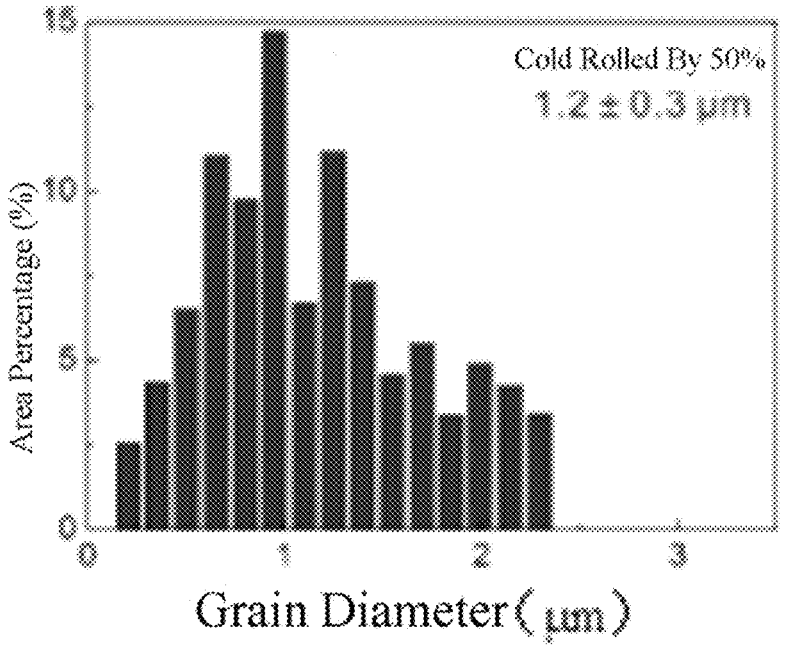
FIG. 26 shows a bar chart of grain size distribution of the magnesium having ultra-high room-temperature formability in Example 7 after cold rolled by 50%.

FIG. 24 shows a bar chart of grain size distribution of the magnesium having ultra-high room-temperature formability in Example 7 in an extruded state. FIG. 25 shows a bar chart of grain size distribution of the magnesium having ultra-high room-temperature formability in Example 7 compressed by 50% at room temperature. FIG. 26 shows a bar chart of grain size distribution of the magnesium having ultra-high room-temperature formability in Example 7 after cold rolled by 50%.

As can be seen from FIGS. 21-26, the average grain diameters of Comparative Example 5 and Example 7 were 82 μm (see FIG. 21) and 1.3 μm (see FIG. 24) respectively. When Comparative Example 5 extruded at 400° C. was compressed or cold rolled by 20% at room temperature, the average grain diameter of Comparative Example 5 was reduced to 56.1 μm (see FIG. 22) or 60.7 μm (see FIG. 23) due to the generation of twin crystals. Completely differently, after Example 7 according to the present disclosure was compressed or rolled by 50% at room temperature, both the size and shape of the grains exhibit no obvious change (see FIGS. 25 and 26).

Figure 27:
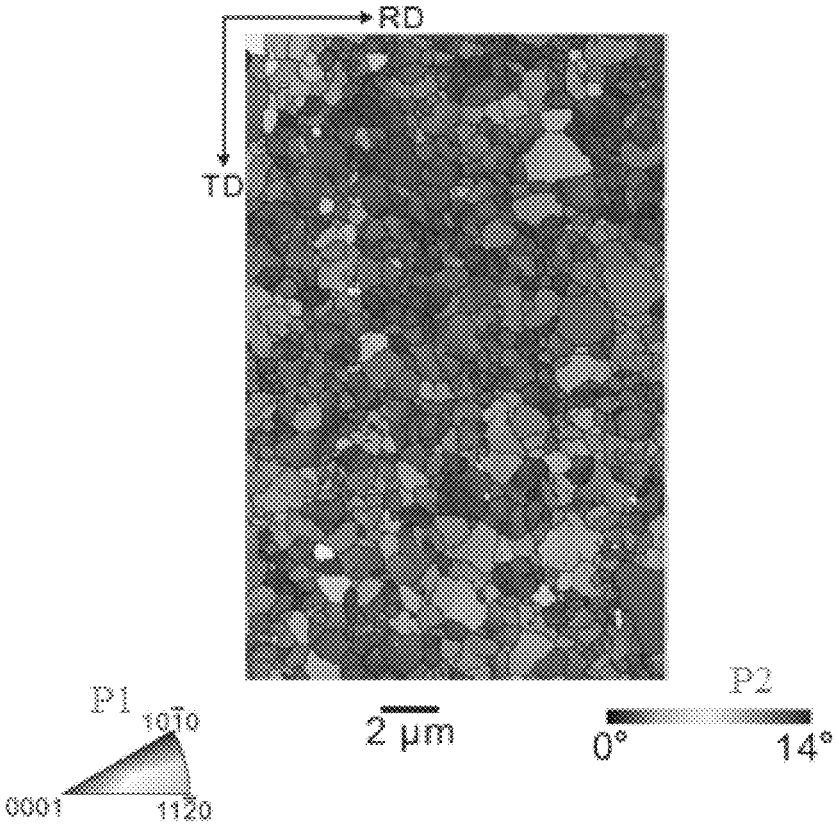
FIG. 27 shows an electron backscatter diffraction (EBSD) image of the magnesium having ultra-high room-temperature formability in Example 7 when processed into a 0.12 mm thick magnesium flat product.
Figure 28:
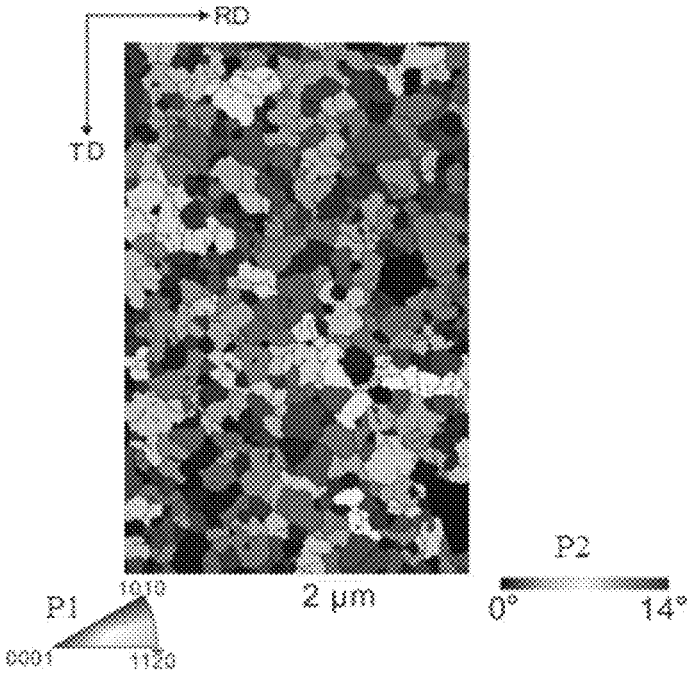
FIG. 28 shows a GOS image of the magnesium having ultra-high room-temperature formability in Example 7 when processed into a 0.12 mm thick magnesium flat product.
Figure 29:
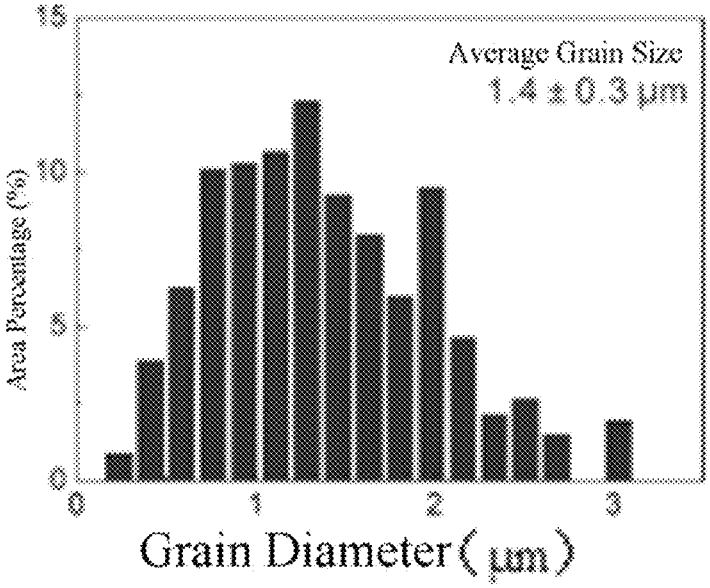
FIG. 29 shows a bar chart of grain size distribution of the magnesium having ultra-high room-temperature formability in Example 7 when processed into a 0.12 mm thick magnesium flat product.
Figure 30:
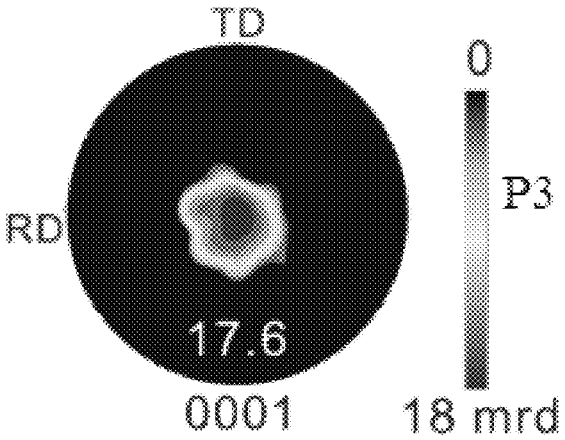
FIG. 30 shows schematically a (0001) pole figure of the texture of the magnesium having ultra-high room-temperature formability in Example 7 when processed into a 0.12 mm thick magnesium flat product.

FIGS. 27-30 show an EBSD image, a GOS image, a texture image and a bar chart of grain size distribution of the magnesium having ultra-high room-temperature formability in Example 7 when processed into a 0.12 mm thick magnesium flat product, wherein FIG. 27 shows an electron backscatter diffraction (EBSD) image of the magnesium having ultra-high room-temperature formability in Example 7 when processed into a 0.12 mm thick magnesium flat product; FIG. 28 shows a GOS image of the magnesium having ultra-high room-temperature formability in Example 7 when processed into a 0.12 mm thick magnesium flat product; FIG. 29 shows a bar chart of grain size distribution of the magnesium having ultra-high room-temperature formability in Example 7 when processed into a 0.12 mm thick magnesium flat product; and FIG. 30 shows schematically a (0001) pole figure of the texture of the magnesium having ultra-high room-temperature formability in Example 7 when processed into a 0.12 mm thick magnesium flat product.

In order to study the deformation modes of the extruded samples of Comparative Example 5 and Example 7 in the shaping process at room temperature, the present inventors polished the side surfaces of these samples (i.e. the faces parallel to the extrusion direction) respectively, and subjected the above samples to compression testing at room temperature respectively. The present inventors discovered that when the extruded sample of Comparative Example 5 was compressed by 20%, a good number of signs indicating the activation of crystal twinning and slip appeared on its side surfaces (see a and b in FIG. 31, wherein this phenomenon can be observed at locations labeled by T and S). In contrast, such crystal twinning and slip bands were not observed on the side surfaces of the extruded sample of Example 7 after compression.

In order to explore the deformation mechanism at room temperature of the extruded sample of Example 7, the present inventors characterized the microstructures of the extruded sample of Example 7 before and after compression at room temperature using a quasi-in-situ EBSD method. The present inventors discovered that when the sample was compressed by 6%, a "new" grain appeared (see c and d in FIG. 31, wherein the cross in d labels the location where the "new" grain appeared). This "new" grain was possibly below grains 1-4 before compression. In the compression, this "new" grain rose to the sample surface by way of crystal boundary slip. Of course, this grain was also possibly formed by recrystallization. In this "new" grain, the intragrain misorientation observed was possibly generated due to intragrain deformation after the recrystallization.

Figure 31:
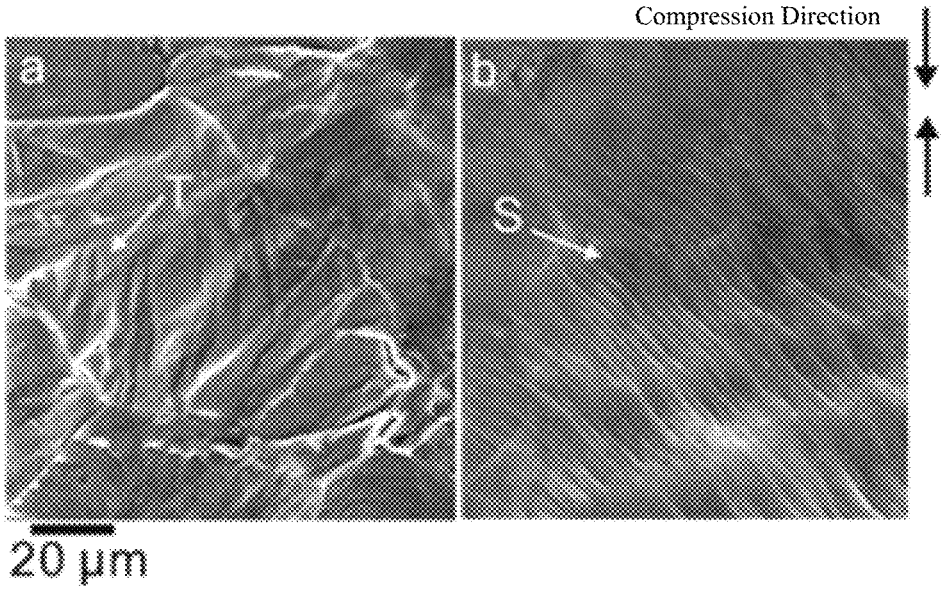
FIG. 31 shows scanning electron microscopic images exhibiting crystal twinning and slip activation in room temperature deformation of Comparative Example 5.

FIG. 31 shows scanning electron microscopic images exhibiting crystal twinning and slip activation in room temperature deformation of Comparative Example 5. As shown by FIG. 31, a in this figure illustrates the twinning crystals generated in Comparative Example 5 after being compressed by 20% at room temperature, and b in this figure illustrates the slip bands generated in Comparative Example 5 after being compressed by 20% at room temperature.

Figure 32:
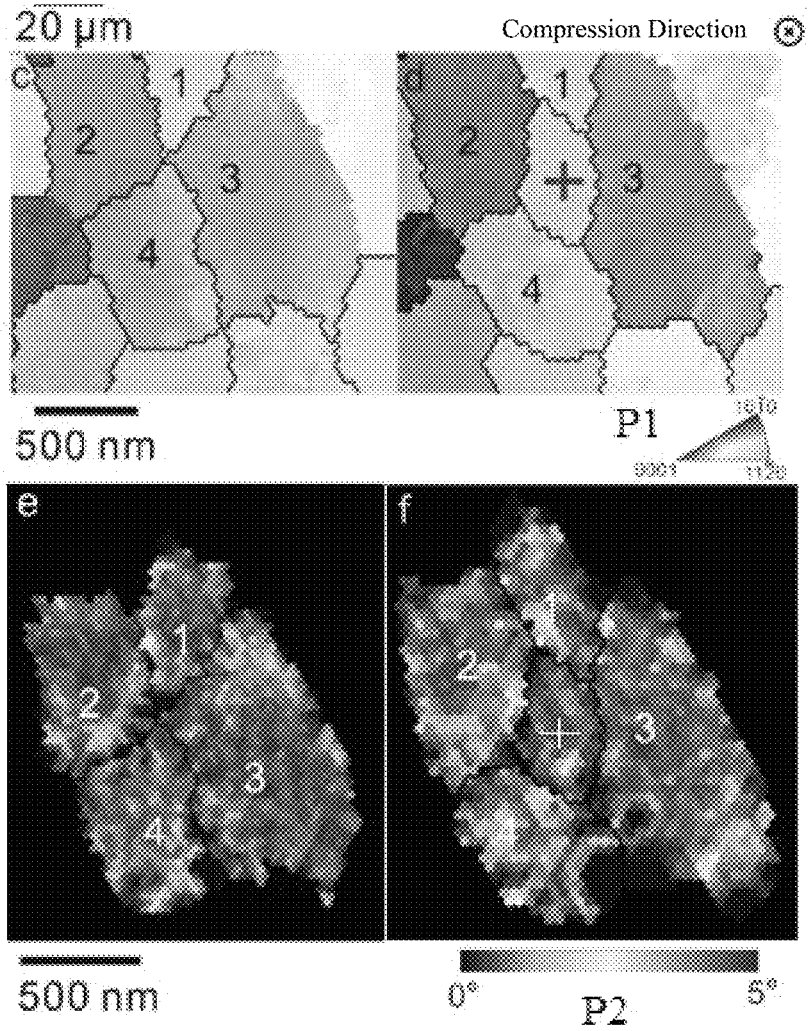
FIG. 32 shows schematically grain variation of the magnesium having ultra-high room-temperature formability in Example 7 compressed at room temperature according to the present disclosure.

In addition, FIG. 32 shows schematically grain variation of the magnesium having ultra-high room-temperature formability in Example 7 compressed at room temperature according to the present disclosure. As shown by FIG. 32, c in this figure illustrates the microstructure of Example 7 before being compressed by 6% at room temperature; d in this figure illustrates the microstructure of the zone shown by c after Example 7 was compressed by 6% at room temperature; e in this figure illustrates an image of the various grains by scanning the zone shown by c using the Kernel average misorientation method (referred to as KAM in short hereafter) before Example 7 was compressed by 6% at room temperature; and f illustrates an image of the various grains by scanning the zone shown by c using the KAM method after Example 7 was compressed by 6% at room temperature. The cross signs in d and f indicate the same location.

To further investigate the deformation mechanism of Example 7, two new grains showing up in the high strain zone of the deformed grains were compared with said "new" grain (i.e. the grain at the locations labeled with the cross signs in d and fin FIG. 32). The two new grains appearing in the high strain zone had very low intragrain misorientation, suggesting that these two new grains had a very low degree of intragrain deformation as compared with the deformed grains surrounding them. This phenomenon is a typical feature indicating occurrence of dynamic recrystallization. In the extrusion of pure magnesium at room temperature, the dynamic recrystallization reduced the grain size from 2 mm to 0.8 μm. This discovery is a circumstantial evidence proving the occurrence of dynamic recrystallization in the room-temperature compression of the extruded sample of Example 7.

Figure 33:
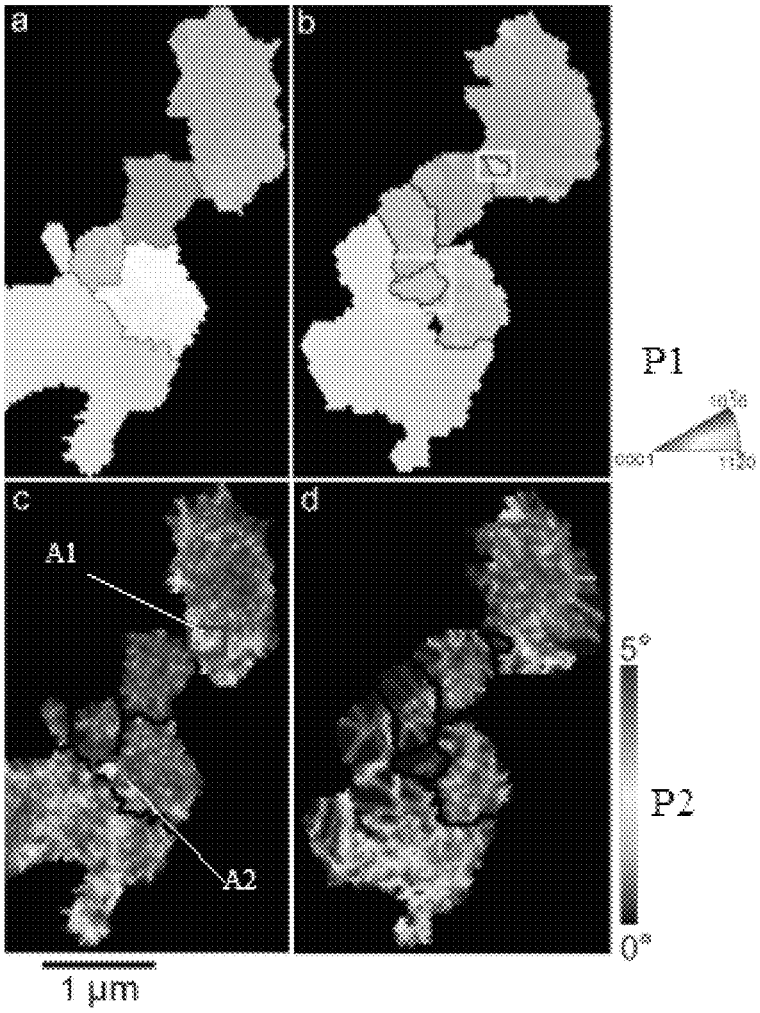
FIG. 33 shows schematically, in a high strain zone, variation of the deformed grains of the magnesium having ultra-high room-temperature formability in Example 7 compressed at room temperature.
Figure 34:
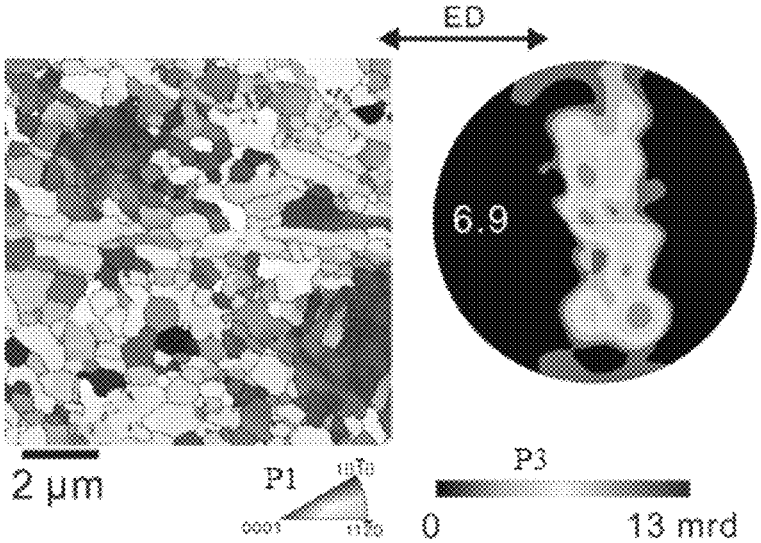
FIG. 34 shows schematically a microstructure and a texture of dynamically recrystallized grains in FIG. 33.

The microstructure and texture of said two grains are shown in FIG. 34. The grain size was determined to be 0.8 microns. FIG. 34 shows schematically the microstructure and texture of the dynamically recrystallized grains in FIG. 33, while FIG. 33 shows schematically, in a high strain zone, variation of the deformed grains of the magnesium having ultra-high room-temperature formability in Example 7 compressed at room temperature.

As shown by FIG. 33, a in this figure is a quasi-in-situ EBSD image of Example 7 before being compressed at room temperature; b in this figure is an EBSD image of Example 7 after being compressed at room temperature, reflecting a local microstructure after compression, wherein the block in b indicates appearance of a new grain having low strain in the compression; c in this figure is a KAM image of Example 7 before being compressed at room temperature, wherein blocks A1 and A2 in c indicate high strain zones before the compression; and d in this figure is a KAM image of Example 7 after being compressed at room temperature.

As such, the present inventors discovered that the major deformation mechanisms of Comparative Example 5 were intragrain slip and crystal twinning due to the coarse grains of Comparative Example 5; whereas the major deformation mechanisms of Example 7 were crystal boundary mechanisms, including grain boundary slip, grain rotation and dynamic recrystallization, because of the fine grains in Example 7 according to the present disclosure.

Figure 35:
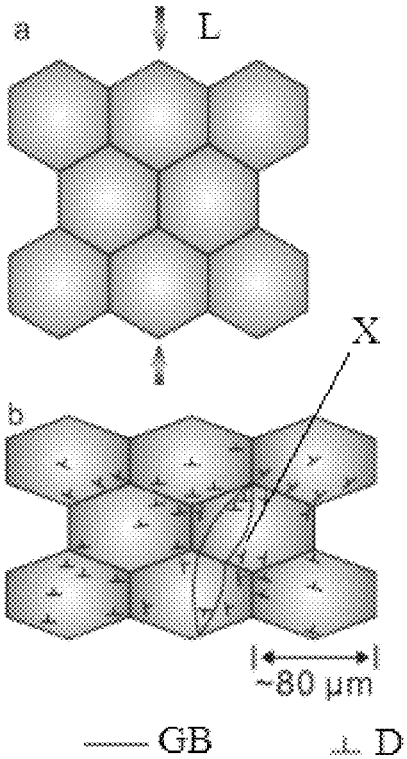
FIG. 35 shows schematically variation of the microstructure of the conventional magnesium in Comparative Example 5 before and after being compressed at room temperature.

FIG. 35 shows schematically variation of the microstructure of the conventional magnesium in Comparative Example 5 before and after being compressed at room temperature.

As shown by FIG. 35, a in this figure illustrates the microstructure of Comparative Example 5 before being compressed at room temperature, while b in this figure illustrates the microstructure of Comparative Example 5 after being compressed at room temperature. As shown by the combination of a and b, the deformation mechanisms of Comparative Example 5 were intragrain slip and crystal twinning due to the coarse grains.

In FIG. 35, D stands for intragrain slip, GB for grain boundary, X for twin crystal boundary, and L for loading.

Figure 36:
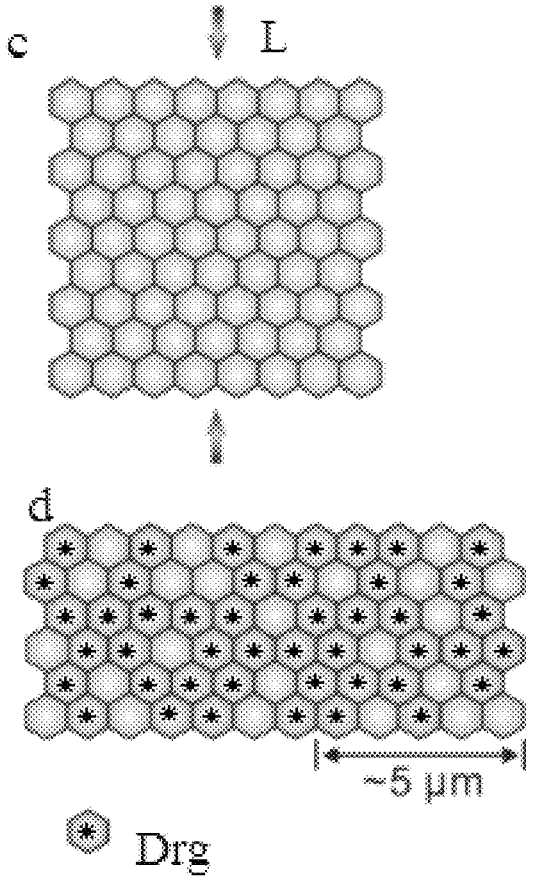
FIG. 36 shows schematically variation of the microstructures of the magnesium having ultra-high room-temperature formability in Examples 1-12 before and after being compressed at room temperature.
Figure 37:
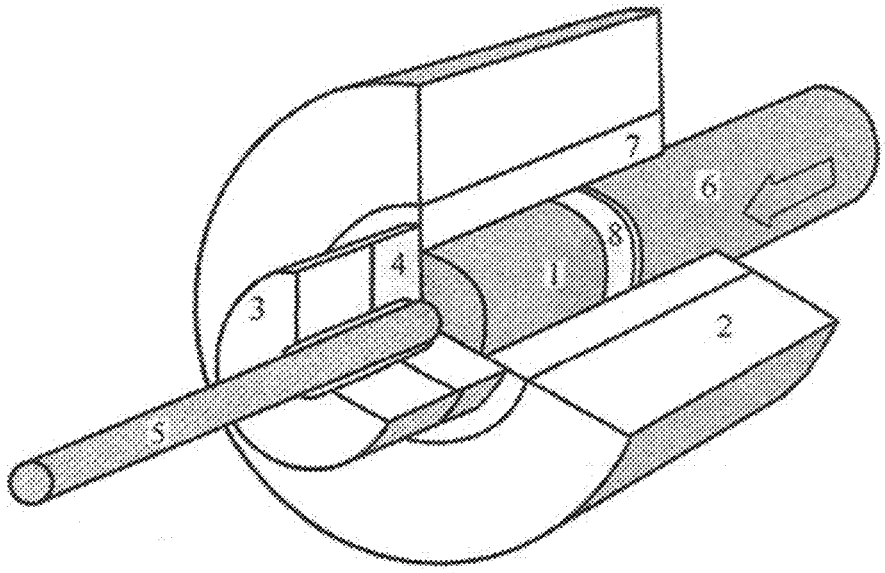
FIG. 37 is a schematic view depicting an exemplary extrusion operation in an embodiment of the present disclosure.

FIG. 36 shows schematically variation of the microstructures of the magnesium having ultra-high room-temperature formability in Examples 1-12 before and after being compressed at room temperature.

As shown by FIG. 36, c in this figure illustrates the microstructures of Examples 1-12 before being compressed at room temperature; and d compressed at room temperature illustrates the microstructures of Examples 1-12 after being compressed at room temperature. As can be seen from the combination of c and d, due to the fine grains, the deformation mechanisms of Examples 1-12 were crystal boundary mechanisms, including grain boundary slip, grain rotation and dynamic recrystallization.

In FIG. 36, L stands for loading, and Drg stands for dynamically recrystallized grains.

It should be noted that in the above figures, P1 is a legend for crystal orientation; P2 is a legend for grain orientation spread; P3 is a graphical representation for a pole figure of texture; ED represents extrusion direction; CD represents compression direction; RD represents rolling direction; ND represents normal direction; and TD represents traverse direction.

In addition, it's to be further noted that in the above solutions, "20%" in "compressed by 20% at room temperature" involved means that the height of a sample after being compressed is reduced by 20% in the compression direction as compared with the sample before being compressed. Likely, "50%" in "compressed by 50% at room temperature" involved means that the height of a sample after being compressed is reduced by 50% in the compression direction as compared with the sample before being compressed. "20%" in "cold rolled by 20%" means that the height of a sample after cold rolled is reduced by 20% in the reduction direction as compared with the sample before being cold rolled. Likely, "50%" in "cold rolled by 50%" means that the height of a sample after cold rolled is reduced by 50% in the reduction direction as compared with the sample before being cold rolled.

To sum up, as can be seen from the Examples according to the present disclosure and FIGS. 1-36 in combination, even though coarse grain magnesium (i.e. the conventional magnesium in the Comparative Examples having a grain size of >2 μm) and fine grain magnesium (i.e. the magnesium having ultra-high room-temperature formability according to the present disclosure having a grain size of ≤2 μm) have similar textures, their deformation processes at room temperature are dominated by different deformation mechanisms. For coarse grain magnesium, its room-temperature deformation modes are intragrain slip and crystal twinning. These two deformation modes both are intragrain deformations. In this case, it's very important to weaken texture and activate more room-temperature intragrain deformation modes in order to increase room-temperature formability. When the grain size is reduced to 2 μm (i.e. the magnesium having ultra-high room-temperature formability according to the present disclosure), grain boundary slip, together with grain rotation and dynamic recrystallization, becomes the main mode. Therefore, intragrain strain will not accumulate to such a degree that will lead to breakage. In this case, those factors that influence intragrain deformation, such as texture, dislocation slip, crystal twinning and the like, will become less important. Hence, the magnesium or magnesium alloy having ultra-high room-temperature formability according to the present disclosure and the section or flat product manufactured therefrom all have excellent ultra-high room-temperature formability, capable of being shaped at room temperature. In addition, the method for manufacturing the magnesium or magnesium alloy having ultra-high room-temperature formability is simple and easy to implement, and can be applied to industrial production.

Examples 13-20 illustrate a number of magnesium alloys having various compositions, prepared using the corresponding process parameters listed in Table 1, and resulting in the characteristic average grain sizes and structures listed in Table 2. The corresponding product samples all exhibit good ultra-high room-temperature formability.

It's to be noted that the prior art portions in the protection scope of the present disclosure are not limited to the examples set forth in the present application file. All the prior art contents not contradictory to the technical solution of the present disclosure, including but not limited to prior patent literature, prior publications, prior public uses and the like, may all be incorporated into the protection scope of the present disclosure.

In addition, the ways in which the various technical features of the present disclosure are combined are not limited to the ways recited in the claims of the present disclosure or the ways described in the specific examples. All the technical features recited in the present disclosure may be combined or integrated freely in any manner, unless contradictions are resulted.

It's also to be noted that only some specific examples of the present disclosure are listed above. Obviously, the present disclosure is not limited to the above examples to which many similar variations can be made. All modifications directly derived or contemplated from the present disclosure by those skilled in the art fall in the protection scope of the present disclosure.

What is claimed is:

1. A manufacturing method for manufacturing a magnesium alloy extrusion product, extruding a magnesium alloy raw material ingot at a temperature of 20-80° C. and an extrusion ratio of 10:1 to 100:1 to obtain the magnesium alloy extrusion product, wherein the magnesium alloy extrusion product consists of magnesium, silver, and strontium and has ultra-high room temperature formability and a grain size of ≤2 μm.

2. The manufacturing method according to claim 1, wherein the magnesium alloy raw matermial ingot is extruded at an extrusion push rod speed of 0.05 mm/s-50 mm/s.

3. The manufacturing method according to claim 1, wherein the magnesium alloy extrusion product has a grain size of ≤1 μm.

4. The manufacturing method according to claim 1, wherein the magnesium alloy extrusion product is further rolled at 20-100° C. to form a magnesium alloy plate consisting of magnesium, silver, and strontium.

5. The manufacturing method according to claim 4, wherein the magnesium alloy plate has a thickness of 0.3 mm to 4 mm or 0.04 to 0.03 mm.

6. The manufacturing method according to claim 1, wherein a total mass percentage of silver and strontium is ≤1.5%.

* * * * *